US008864299B2

(12) United States Patent
Suzuki et al.

(10) Patent No.: US 8,864,299 B2
(45) Date of Patent: Oct. 21, 2014

(54) IMAGE FORMING APPARATUS AND IMAGE FORMING METHOD

(71) Applicants: Yoshinari Suzuki, Kanagawa (JP); Yukihito Niino, Tokyo (JP); Kazuki Yasu, Kanagawa (JP)

(72) Inventors: Yoshinari Suzuki, Kanagawa (JP); Yukihito Niino, Tokyo (JP); Kazuki Yasu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/076,111

(22) Filed: Nov. 8, 2013

(65) Prior Publication Data

US 2014/0132658 A1 May 15, 2014

(30) Foreign Application Priority Data

Nov. 12, 2012 (JP) ..... 2012-248645

(51) Int. Cl.
*B41J 2/01* (2006.01)
*B41J 11/00* (2006.01)

(52) U.S. Cl.
CPC ..... *B41J 11/002* (2013.01); *B41J 11/0015* (2013.01)
USPC ..... 347/102

(58) Field of Classification Search
USPC ..... 347/14, 19, 102
See application file for complete search history.

(56) References Cited

U.S. PATENT DOCUMENTS

| | | | | |
|---|---|---|---|---|
| 7,338,143 | B2 | 3/2008 | Onishi et al. | |
| 8,240,839 | B2 | 8/2012 | Yamanobe | |
| 8,398,226 | B2 * | 3/2013 | Higgins et al. | 347/101 |
| 8,585,198 | B2 * | 11/2013 | Onishi et al. | 347/102 |
| 8,651,651 | B2 * | 2/2014 | Takaku et al. | 347/100 |
| 2005/0212882 | A1 | 9/2005 | Naniwa | |

FOREIGN PATENT DOCUMENTS

| | | |
|---|---|---|
| JP | 61-059911 | 3/1986 |
| JP | 06-071882 | 3/1994 |
| JP | 11-334114 | 7/1999 |
| JP | 2004-330568 | 11/2004 |
| JP | 2005-271290 | 10/2005 |
| JP | 4114608 | 7/2008 |
| JP | 2010-005815 | 1/2010 |

* cited by examiner

*Primary Examiner* — Lamson Nguyen
(74) *Attorney, Agent, or Firm* — Duft Bornsen & Fettig LLP

(57) ABSTRACT

An image forming apparatus includes a pretreatment unit to apply a pretreatment liquid on a recording medium before an image is formed on the recording medium, a posttreatment unit to apply a posttreatment liquid on the recording medium after the image is formed on the recording medium, and a dry unit to dry the image formed on the recording medium and the posttreatment liquid. The pretreatment unit controls an applying amount of the pretreatment liquid based on resolution of the image to be formed on the recording medium, the posttreatment unit controls an applying amount of the posttreatment liquid based on the resolution of the image to be formed on the recording medium, and the dry unit controls drying strength based on the resolution of the image to be formed on the recording medium.

7 Claims, 11 Drawing Sheets

IMAGE FORMING APPARATUS AND IMAGE FORMING METHOD

RELATED APPLICATIONS

The present application claims priority to and incorporates by reference the entire contents of Japanese Patent Application No. 2012-248645 filed in Japan on Nov. 12, 2012.

BACKGROUND OF THE INVENTION

1. Field of the Invention

The disclosures discussed herein relate to an image forming apparatus and an image forming method.

2. Description of the Related Art

Image forming apparatuses employing an ink-jet system exhibit excellent apparatus downsizing and reduced-noise properties. The ink-jet system may be defined as a system to discharge ink (liquid droplets) onto a recording medium to form an image on a surface of the recording medium.

Japanese Laid-open Patent Publication No. 2004-330568 (hereinafter referred to as "Patent Document 1") discloses a technology in an inkjet printer to coat a precoat liquid serving as a pretreatment liquid to form an ink-receiving layer on a continuous form sheet of paper, apply activation to aggregate pigments of pigmented ink to the continuous form sheet, and discharge the ink on a surface of the continuous form sheet to form images.

Such an inkjet printer generally employs a method of coating the transported continuous form sheet with the precoat liquid discharged by a spray, and drying the recording sheet by heating before and after the transported continuous form sheet is coated with the precoat liquid.

However, with this method, a recorded result appears to have low resistance to scuffing. That is, the pigmented ink is susceptible to easily coming off since the pigments of the pigmented ink are adhered to the surface of the recording medium. Hence, the inkjet printer further employs a method of coating the recorded images with a posttreatment liquid having a resin film, and the like to physically protect the recorded images in order to improve the resistance to scuffing.

However, in the inkjet printer, an optimal coating amount of the pretreatment liquid (i.e., the precoat liquid) may, for example, vary with printing conditions, and hence, the optimal coating amount of the pretreatment liquid may vary with the resolution of images to be recorded.

For example, in a case of recording low resolution images, ink dot diameters to be formed on the recording sheet tend to be large compared to a case of recording high resolution images. As a result, it may take a longer time to dry the ink due to the greater ratio of surface to ink volume for each of the dots. In addition, a recording velocity is higher in printing the low resolution images than the high resolution images, which may also result in taking a longer time to dry the ink. This indicates low permeability, which may cause ink spreading or ink beading.

Thus, a method for optimally controlling the coating amount of the pretreatment liquid has been desired in order to prevent ink spreading or ink beading.

Further, a longer coating time may be required for coating the recorded images with the posttreatment liquid, due to a large amount of the posttreatment liquid being required. Hence, there has been required a method of reducing the coating time.

Moreover, when the coating amount of the pretreatment liquid and the discharging amount of the posttreatment liquid are different, the following drawbacks may need to be dealt with after the drying process. That is, after the drying process, the recorded sheet may result insufficient dryness when the amounts of the pretreatment liquid and the posttreatment liquid are large, and the recorded sheet may shrink due to excessive dryness when the amounts of the pretreatment liquid and the posttreatment liquid are small.

RELATED ART DOCUMENTS

Patent Document

Patent Document 1: Japanese Laid-open Patent Publication No. 2004-330568

SUMMARY OF THE INVENTION

Accordingly, it is a general object in one embodiment of the present invention to provide an image forming apparatus capable of controlling an applying amount of a pretreatment liquid, an applying amount of a posttreatment liquid, and drying strength of a dry unit to optimize the applying amount of the pretreatment liquid, the applying amount of the posttreatment liquid, and the drying strength of the dry unit.

According to one aspect of the embodiment, there is provided an image forming apparatus configured to eject liquid droplets onto a recording medium to form an image on a surface of the recording medium. The image forming apparatus includes a pretreatment unit configured to apply a pretreatment liquid on the surface of the recording medium before the image is formed on the surface of the recording medium; a posttreatment unit configured to apply a posttreatment liquid on the recording medium after the image is formed on the surface of the recording medium; and a dry unit configured to dry the image formed on the recording medium and the posttreatment liquid. In the image forming apparatus, the pretreatment unit controls an applying amount of the pretreatment liquid based on resolution of an image to be formed on the recording medium, the posttreatment unit controls an applying amount of the posttreatment liquid based on the resolution of the image to be formed on the recording medium, and the dry unit controls drying strength based on the resolution of the image to be formed on the recording medium.

The object and advantages of the invention will be realized and attained by means of the elements and combinations particularly pointed out in the claims.

It is to be understood that both the foregoing general description and the following detailed description are exemplary and explanatory and are not restrictive of the invention as claimed.

Other objects and further features of the present invention will be apparent from the following detailed description when read in conjunction with the accompanying drawings.

DESCRIPTION OF THE PREFERRED EMBODIMENTS

Figure 1:
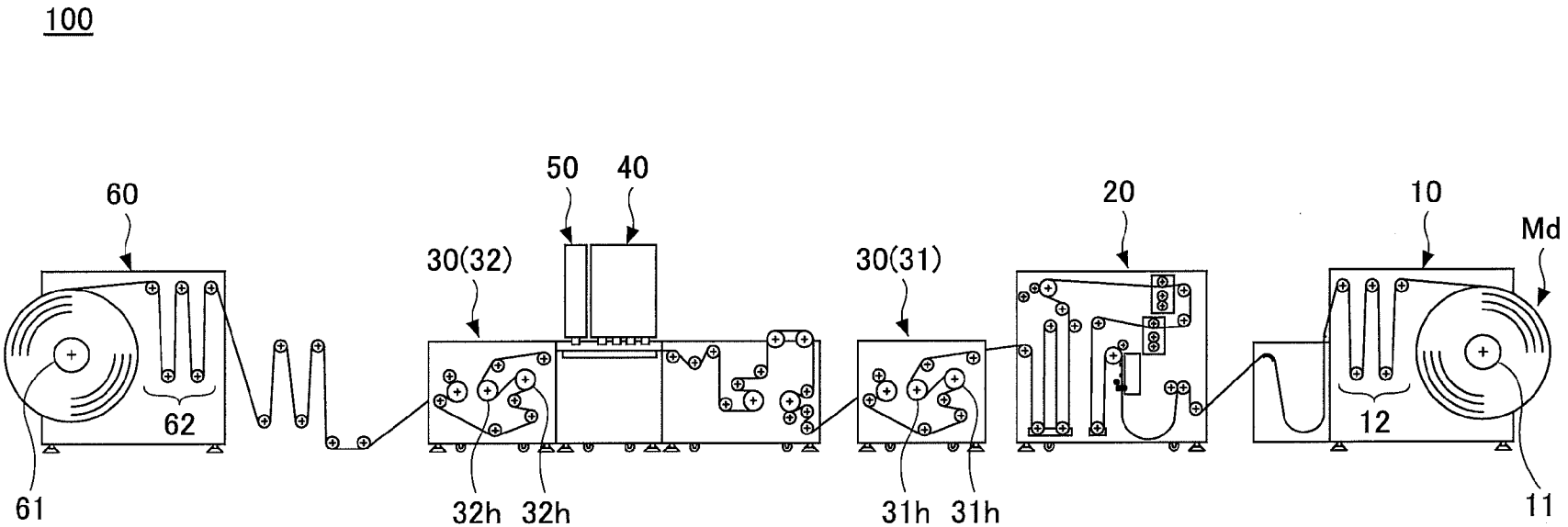
FIG. 1 is a schematic side view illustrating an example of an image forming apparatus according to a first embodiment.

A description will be given of embodiments of the present invention, by referring to the accompanying drawings.

First Embodiment

Initially, an image forming apparatus is illustrated according to a first embodiment.

In the following, a description is given of the inkjet image forming apparatus that forms an image on a recording medium according to the first embodiment. Note that the first embodiment may be applied to any one of a printer, a scanner, an imager, a plotter, a facsimile machine, and the like insofar as these apparatuses have a discharge device (e.g., a discharge head, an ink head, a recording head, an inkjet head, etc.) configured to discharge liquid droplets such as ink to form (or print or copy) an image on a surface of a recording medium other than the image forming apparatus described below.

Configuration of Image Forming Apparatus

An image forming apparatus 100 according to a first embodiment is described below with reference to FIGS. 1 to 5.

Note that in this embodiment, a description is given of the image forming apparatus having ejecting heads (i.e., a recording head or an ink-head) ejecting ink of four colors, that is, black (B), cyan (C), magenta (M), and yellow (Y). However, the image forming apparatus to which the embodiment is applied is not limited to the image forming apparatus having the four color ejecting heads. Specifically, the image forming apparatus to which the embodiment is applied may be an image forming apparatus further having ejecting heads corresponding to green (G), red (R), and other colors, or may be an image forming apparatus having an ejecting head corresponding to black (K) color alone. In the following description, suffixes K, C, M, and Y indicate black, cyan, magenta, and yellow, respectively.

Further, in the following embodiments, a continuous form sheet rolled in a roll form (hereinafter called a "roll sheet") is used as a recording medium. However, a recording medium on which the image forming apparatus according to the embodiment forms an image is not limited to the roll sheet, and may include any types of recording medium insofar as an image is formed on the recording medium. For example, the recording medium on which the image forming apparatus according to the embodiment forms an image may be a cut sheet instead of the roll sheet. When the recording medium including the roll sheet and the cut sheet is paper, types of paper to be used as the recording medium include standard paper, high-quality paper, thin paper, thick paper, coated paper, and the like. In addition, an overhead projector (OHP) sheet, a plastic film, a metallic sheet, and other sheet media on the surfaces of which an image is formed with ink or the like may also be used as the recording medium. Note that the roll sheet used in this embodiment is a continuous form sheet (e.g., a continuous document sheet or continuous form sheet) having lines of perforations disposed at predetermined intervals along which parts of the roll sheet may be torn off. Note that each of pages of the roll sheet indicates a region sandwiched between the lines of perforations disposed at the predetermined intervals.

As illustrated in FIG. 1, the image forming apparatus 100 according to the embodiment includes an introducing unit 10 configured to introduce (carry in) a roll sheet Md (i.e., a recording medium Md), a pretreatment unit 20 configured to pretreat the introduced roll sheet Md, and in some cases, a dry unit 31 configured to dry the pretreated roll sheet Md. The image forming apparatus 100 further includes an image forming unit 40 configured to form an image on a surface of the pretreated roll sheet Md. The image forming apparatus 100 further includes a posttreatment unit 50 configured to posttreat the roll sheet Md on the surface of which the image is formed. The image forming apparatus 100 further includes a dry unit 32 configured to dry the posttreated roll sheet M.

The image forming apparatus 100 further includes a discharge unit 60 configured to discharge the dried roll sheet Md. The image forming apparatus 100 further includes a control unit 70 (see FIG. 6A) configured to control operations of the image forming apparatus 100.

The image forming apparatus 100 according to the embodiment introduces the roll sheet Md by the introducing unit 10, pretreats the surface of the roll sheet Md by the pretreatment unit 20, and dries the surface of the roll sheet Md by the dry unit 31. The image forming apparatus 100 forms an image on the surface of the roll sheet Md which is pretreated, and dried by the dry unit 31. The image forming apparatus 100 posttreats by the posttreatment unit 50 the roll sheet Md on the surface of which the image is formed, and dries the posttreated roll sheet Md by the dry unit 32. The image forming apparatus 100 then discharges (rolls up) the roll sheet Md by the discharge unit 60.

In the following, a description is given of a configuration of each of components of the image forming apparatus 100 according to the embodiment.

Configuration of Introducing Unit

The introducing unit 10 is configured to introduce a recording medium into a pretreatment unit 20 and the like. In this embodiment, the introducing unit 10 is configured to include a feed part 11, plural transport rollers 12, and the like. The introducing unit 10 introduces (moves) the roll sheet Md retained by a feed roll of the feed part 11, and transports the roll sheet Md over a platen (roller) to reach the pretreatment unit 20 and the like.

Note that in this embodiment, the roll sheet is used as the recording medium introduced by the introducing unit 10. However, in a case where a material other than the roll sheet is used as the recording medium, another type of an introducing unit suitable to such a recording medium may be selected.

Configuration of Pretreatment Unit

The pretreatment unit 20 is configured to pretreat the recording medium on which an image is yet to be formed.

In this embodiment, the pretreatment unit 20 pretreats the surface of the roll sheet Md introduced by the introducing unit 10 with a pretreatment liquid.

Note that the pretreatment indicates uniformly coating the surface of the roll sheet Md with the later-described pretreatment liquid.

Hence, when forming an image on the recording medium, the image forming apparatus 100 coats, using the pretreatment unit 20, the surface of the recording medium with the pretreatment liquid having a function to aggregate ink before the image is formed on the recording medium. Hence, when an image is formed by the image forming apparatus 100, quality problems such as smearing, hue, gloss, ink bleed-through, and the like, and other problems such as water resistance, weather resistance, and other image fastness properties of the formed image may be reduced. Specifically, the image forming apparatus 100 may be able to improve the quality of an image to be later formed on the surface of the recording medium by causing the pretreatment unit 20 to apply the pretreatment liquid having a function to aggregate ink to the surface of the recording medium before the image is formed on the recording medium.

Note that when forming an image on an inkjet printing sheet (recording medium), the image forming apparatus 100 may apply the pretreatment liquid having a function to aggregate ink to a surface of the inkjet printing sheet (recording medium) using the pretreatment unit 20.

The pretreatment unit 20 of the image forming apparatus 100 according to the embodiment is not specifically limited to that described above insofar as the pretreatment unit is capable of uniformly applying the pretreatment liquid on the surface of the recording medium, and the pretreatment unit may employ various types of coating methods (application methods), which serve as pretreatment methods, to uniformly apply the pretreatment liquid to the surface of the recording medium. Examples of the pretreatment method include blade coating, gravure coating, gravure offset coating, bar coating, roll coating, knife coating, air knife coating, comma coating, U-comma coating, AKKU coating, smoothing coating, microgravure coating, reverse roll coating, four-to-five rolls coating, dip coating, curtain coating, slide coating, and die coating.

Further, the pretreatment unit 20 of the image forming apparatus 100 according to the embodiment may use a treatment liquid containing a water-soluble aliphatic organic acid as the pretreatment liquid. Such a pretreatment liquid includes properties to aggregate water-dispersible colorant particles. Note that the term "aggregate" indicates that water-dispersible colorant particles are adsorbed to one another to gather together.

Further, the pretreatment unit 20 of the image forming apparatus 100 according to the embodiment may add an ionic substance such as a water-soluble aliphatic organic acid to the pretreatment liquid. The pretreatment liquid including the ionic substance may allow surfaces (i.e., electric charges) of the water-dispersible colorant particles to adsorb ions to neutralize the electric charges on the surfaces. This enhances aggregation action between the molecules to further aggregate water-dispersible colorant particles.

Next, an example of the pretreatment unit 20 employing the roll coating as the pretreatment method is illustrated with reference to FIG. 2.

Figure 2:
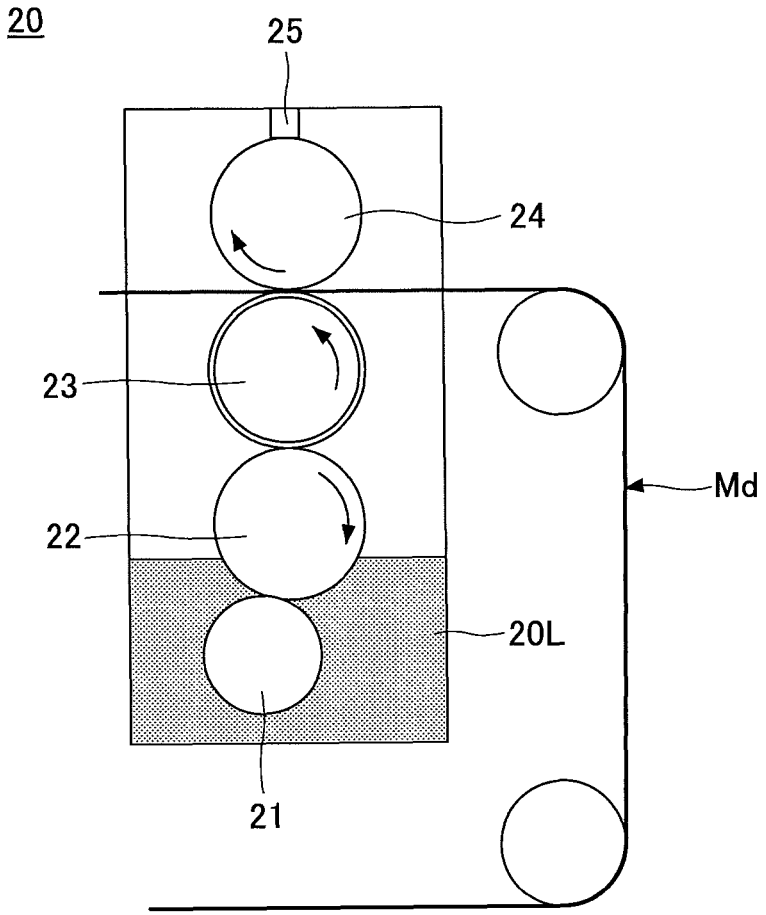
FIG. 2 is a schematic configuration diagram illustrating an example of a pretreatment unit of the image forming apparatus according to the first embodiment.

As illustrated in FIG. 2, the pretreatment unit 20 applies a stored pretreatment liquid 20L to the surface of the roll sheet Md transported (introduced) by introducing unit 10 (see FIG. 1) into the pretreatment unit 20.

Specifically, the pretreatment unit 20 initially transfers the pretreatment liquid 20L from a stirring (supplying) roller 21 and a thinning (transferring) roller 22 to a surface of a coating roller 23 in a thin film form.

Subsequently, the pretreatment unit 20 presses the coating roller 23 against a platen roller 24 so as to rotate the coating roller 23. At this time, the pretreatment unit 20 may apply the pretreatment liquid to the surface of the roll sheet Md by transporting the roll sheet Md to an interval (i.e., a nip) between the coating roller 23 and the platen roller 24.

In addition, the pretreatment unit 20 controls, by using a pressure adjusting device 25, nip pressure acting at the nip position where the coating roller 23 is in contact with the platen roller 24 when applying the pretreatment liquid. Hence, the pretreatment unit 20 may be able to control or change the amount of the pretreatment liquid 20L to be applied by altering the nip pressure with the pressure adjusting device 25.

Further, the pretreatment unit 20 may control respective rotational velocities of the coating roller 23 and the platen roller 24. Hence, the pretreatment unit 20 may be able to control or change the amount of the pretreatment liquid 20L (e.g., a film thickness) to be applied by altering the rotational speed of the coating roller 23 and the like. Note that the pretreatment unit 20 may control the rotational speed of the coating roller 23 and the like by controlling operations of a not-illustrated power source such as a drive motor configured to drive the coating roller 23 and the platen roller 24.

Accordingly, the pretreatment unit 20 of the image forming apparatus 100 according to the embodiment may be able to uniformly apply the pretreatment liquid 20L to the surface of the roll sheet (recording medium) Md using the coating roller 23 and the like. That is, the pretreatment unit 20 according to the embodiment may be able to uniformly and thinly apply the pretreatment liquid 20L to the surface of the roll sheet Md although the pretreatment liquid 20L has relatively high viscosity.

Hence, since the pretreatment unit 20 according to the embodiment uniformly and thinly applies the pretreatment liquid to the surface of the roll sheet Md, ink spreading and the like of images to be formed on the surface of the roll sheet Md thereafter may be reduced, thereby improving the image quality.

Further, the pretreatment unit 20 of the image forming apparatus 100 according to the embodiment may be able to control the amount of the pretreatment liquid 20L to be applied via the coating roller 23, the pressure adjusting device 25, or the like. Hence, the pretreatment unit 20 may be able to apply the pretreatment liquid 20L to the surface of the roll sheet (recording medium) Md in an amount suitable to an image to be formed thereafter.

Configuration of Dry Unit

The dry unit 30 is configured to dry a recording medium by heating or the like. The dry unit 30 in this embodiment is configured to include a pretreatment dry part (pretreatment dry unit) 31 configured to dry the pretreated roll sheet Md that is pretreated by the pretreatment unit 20, and a posttreatment dry part (posttreatment dry unit) 32 configured to dry the posttreated roll sheet Md that is, after an image is formed on the pretreated roll sheet Md, posttreated by the posttreatment unit 50.

The pretreatment dry part 31 may, for example, employ a heat roller 31*h* as illustrated in FIG. 1. Specifically, the pretreatment dry part 31 may heat the heat roller 31*h* to a temperature range of, for example, 40 to 100° C., and may then bring the heat roller 31*h* into contact with the surface of the roll sheet Md to which the pretreatment liquid is applied. Hence, in the pretreatment dry part 31, the pretreatment liquid applied surface of the roll sheet Md may be heated via convection heating from the heat rollers 31*h* such that the roll sheet Md (i.e., the pretreatment liquid applied to the surface of the roll sheet Md) is dried by evaporating moisture content of the pretreatment liquid.

Note that, as described later, the number of heat rollers serving as a dry unit is not limited to the configuration of the dry unit illustrated in FIG. 1, and the number of heat rollers may optionally be selected if required.

Further, the pretreatment dry part 31 serving as the dry unit is not limited to heat rollers. Specifically, the pretreatment dry part 31 may employ infrared drying, microwave drying, warm-air drying, and other drying methods. In addition, the pretreatment dry part 31 may also employ a combination of plural drying methods.

A configuration of the posttreatment dry part 32 is similar to that of the pretreatment dry part 31, and hence, duplicated illustration of the configuration will be omitted from the specification.

Configuration of Image Forming Unit

The image forming unit 40 is configured to form an image on a recording medium. In this embodiment, the image forming unit 40 is configured to eject liquid droplets (hereinafter called "ink") onto the roll sheet Md dried by the dry unit 30 to form an image on the surface of the roll sheet Md.

Figure 3A:
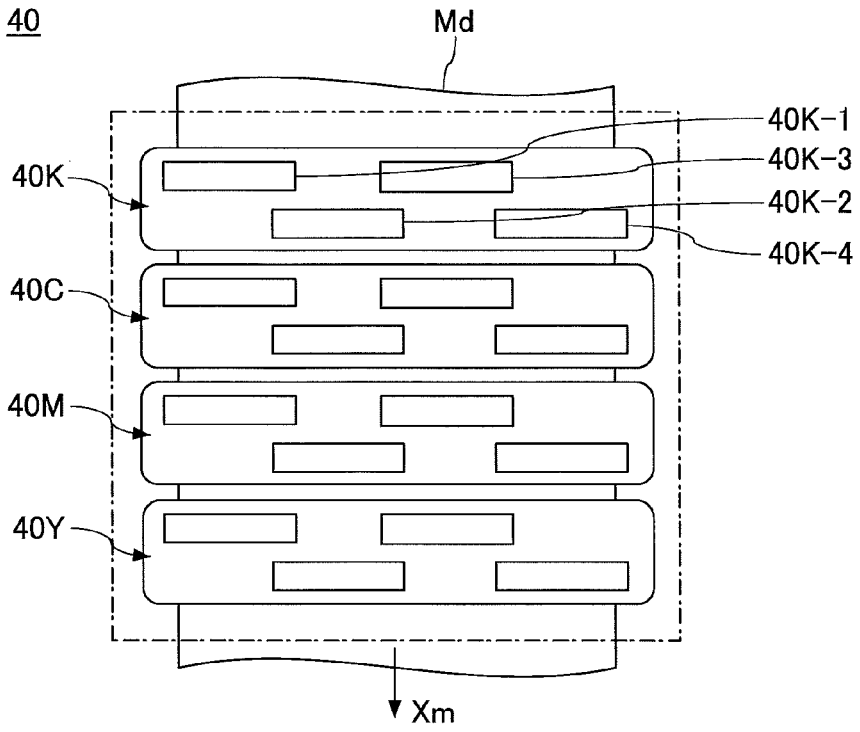
FIGS. 3A and 3B are explanatory diagrams each illustrating an example of an image forming unit of the image forming apparatus according to the first embodiment.
Figure 3B:
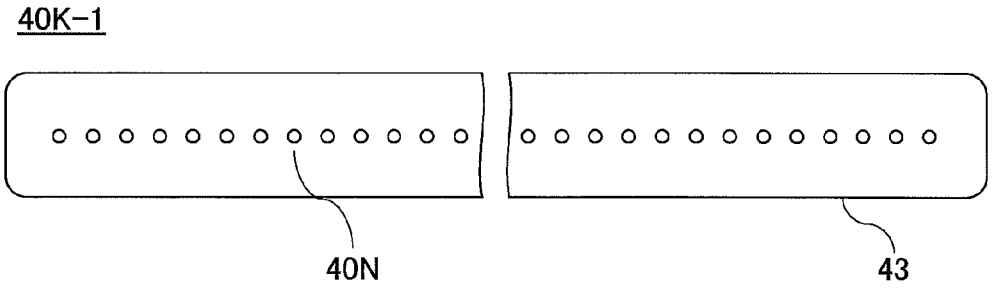

An external shape of a head portion of the image forming unit 40 is described by referring to examples illustrated in FIGS. 3A and 3B. FIG. 3A is a schematic plan diagram illustrating an overall configuration example of the image forming unit 40 of the image forming apparatus according to the embodiment. FIG. 3B is a schematic plan diagram illustrating an example of a main part (i.e., a black (K) ejecting head 40K) of the image forming unit 40.

As illustrated in FIG. 3A, the image forming unit 40 employed in this embodiment is formed of a full-line head. Specifically, the image forming unit 40 includes four ejecting heads 40K, 40C, 40M, and 40Y disposed from upstream in a recording medium transporting direction Xm corresponding to black (K), cyan (C), magenta (M), and yellow (Y).

Note that in this embodiment, the black ejecting head 40K includes four head units 40K-1, 40K-2, 40K-3, and 40K-4 disposed in a staggered fashion in directions perpendicular to the roll sheet Md (recording medium) transporting direction Xm. Hence, the image forming unit 40 may be able to form an image in an entire area in a width direction (i.e., the direction perpendicular to the recording medium transporting direction) of an image forming area (printing area) of the roll sheet (recording medium) Md. Note that configurations of other ejecting heads 40C, 40M, and 40Y are similar to the configuration of the black (K) ejecting head 40K, and hence, duplicated illustrations of such configurations will be omitted from the specification.

FIG. 3B illustrates an enlarged plan diagram of the head unit 40K-1 of the black (K) ejecting head of the image forming unit 40.

As illustrated in FIG. 3B, in this embodiment, the head unit 40K-1 includes plural ejecting ports (i.e., nozzles, or printing nozzles) 40N disposed in a nozzle plate 43 (i.e., an external surface illustrated in a later-described FIG. 4A). Note that the plural ejecting ports 40N are disposed in a line in a longitudinal direction of the head unit 40K-1 to form a nozzle array. Note that the head unit 40K-1 may include plural nozzle arrays.

Figure 4A:
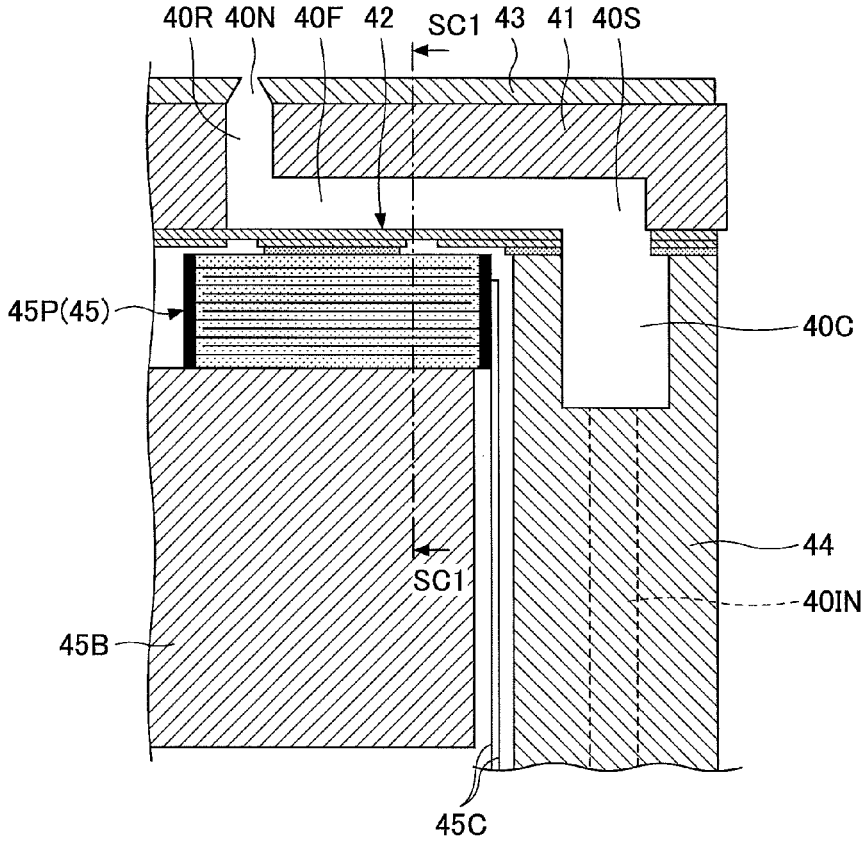
FIGS. 4A and 4B are schematic cross-sectional diagrams each illustrating an example of the image forming unit of the image forming apparatus according to the first embodiment.
Figure 4B:
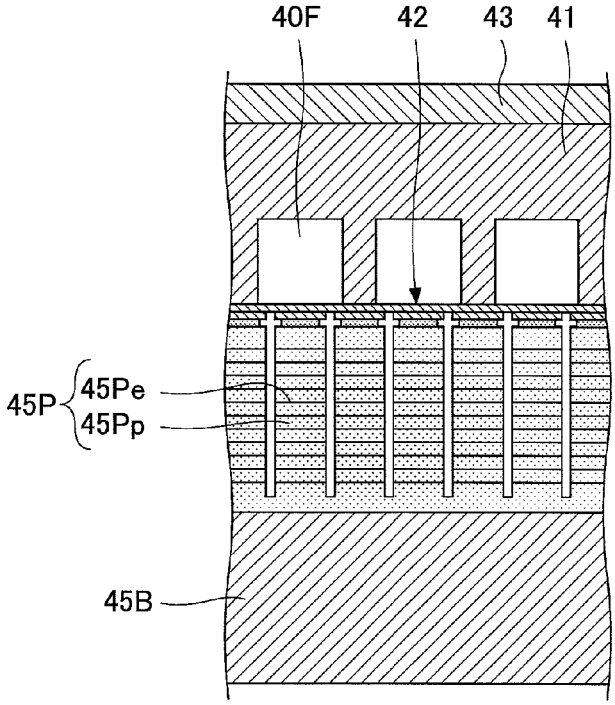

A cross-sectional shape of the ejecting head of the image forming unit 40 is described by referring to examples illustrated in FIGS. 4A and 4B. Note that FIG. 4A is a schematic cross-sectional diagram illustrating an example of a channel (cross section in a longitudinal direction of a liquid chamber 40F) of the image forming unit 40. FIG. 4B is a schematic cross-sectional diagram illustrating an arrangement example of the ejecting ports (a cross-section (i.e., cut along a dash-dot line SC1 in FIG. 4A) in a short direction of the liquid chamber 40F, i.e., in an alignment direction of ejections ports) of the image forming unit 40.

As illustrated in FIG. 4A, in the embodiment, the ejecting head (40K, etc.) of the image forming unit 40 is configured to include a channel plate 41 configured to form an passage of ink, a diaphragm 42 configured to be connected to a lower surface of the channel plate 41 (in an inward direction of the ejecting head), a nozzle plate 43 configured to be connected to an upper surface of the channel plate 41 (in an outward direction of the ejecting head), and a frame member 44 configured to maintain (be connected to) a circumferential part of the diaphragm 42. The ejecting head is configured to further include a pressure generating unit (i.e., an actuator unit) 45.

The ejecting head (40K, etc.) in this embodiment includes a nozzle communicating passage 40R and a liquid chamber 40F formed by layering the channel plate 41, the diaphragm 42, and the nozzle plate 43. The nozzle communicating passage 40R and the liquid chamber 40F are configured to communicate with the ejecting port (nozzle) 40N. The ejecting head further includes an ink inlet port 40S via which ink is supplied to the liquid chamber 40F, and a common liquid chamber 40C configured to supply ink by further layering a frame member 44.

Further, the ejecting head in the embodiment is configured to cause the diaphragm 42 to undergo warping deformation using the pressure generating unit 45. The ejecting head may be able to change the pressure applied to ink inside the liquid chamber 40F by changing the volume (capacity) of the liquid chamber 40F. As a result, the ejecting head may be able to eject ink from the ejecting ports 40N.

The channel plate 41 may include a single crystal silicone substrate having a crystal face orientation (100). In this configuration, the channel plate 41 may be able to include a recess portion and a hole serving as the nozzle communicating passage 40R and the liquid chamber 40F that are formed by anisotropic etching using an alkaline etcher such as a potassium hydroxide aqueous solution (KOH). Note that a material used for the channel plate 41 is not limited to the single crystal silicone substrate. Specifically, the channel plate 41 may include a stainless steel substrate, photosensitive resin, and other materials.

The diaphragm 42 may include a nickel metal plate. Hence, the diaphragm 42 may be formed by nickel electroforming. Note that the diaphragm 42 may include a connecting member or the like for connecting between a metal plate other than the nickel metal plate and the resin plate.

The nozzle plate 43 may be formed of a single crystal silicone substrate. Hence, the nozzle plate 43 may be formed by anisotropic etching, in a manner similar to the anisotropic etching performed on the channel plate 41. Note that the nozzle plate 43 may include a water repellant layer on an external surface formed of a metallic member via a predetermined layer.

The nozzle plate 43 in this embodiment includes plural nozzles 40N configured to eject liquid droplets (ink droplets). Specifically, the nozzle plate 43 includes nozzles 40N, each having a diameter of 10 to 30 μm corresponding to liquid chambers 40F.

The frame member 44 may be made of thermosetting resin such as epoxy resin or polyphenylene sulfide (PPS). Hence, the frame 44 may be formed by injection molding.

Further, in this embodiment, the frame 44 includes a housing part (a penetrating part) configured to house the pressure generating unit 45, a recess part serving as the common liquid chamber 40C, and an ink supply port 401N configured to supply ink into the common liquid chamber 40C from a component outside the ejecting head.

The pressure generating unit 45 may include an electromechanical transducer element. The pressure generating unit 45 may include a piezoelectric element 45P serving as the electromechanical transducer element, a base substrate 45B configured to connectively secure the piezoelectric element 45P, and a column part disposed between the piezoelectric elements 45P. Further, the piezoelectric element 45P of the pressure generating unit 45 includes a flexible printed cable (FPC) 45C or the like for connecting the piezoelectric element 45P of the pressure generating unit 45 to a not illustrated drive circuit (a drive IC).

As illustrated in FIG. 4B, the piezoelectric element 45P may include a layered piezoelectric element formed by alternately layering a piezoelectric material 45Pp (e.g., PZT) and an internal electrode 45Pe. Note that individual electrodes Pei and a common electrode 45Pec are connected to the internal electrodes 45Pe drawn to alternately different end surfaces of the piezoelectric materials 45Pp.

Further, the piezoelectric element 45P in this embodiment employs a d33 direction as a piezoelectric direction of the piezoelectric materials 45Pp. Hence, the pressure generating unit 45 may be able to pressurize (compress) or depressurize (decompress) ink inside the liquid chamber 40F using a piezoelectric effect (displacement in d33 direction) of the piezoelectric element 45P. Note that the pressure generating unit 45 may pressurize or depressurize ink inside the liquid chamber 40F using displacement in a d31 direction of the piezoelectric element 45P. Further, the pressure generating unit 45 may include one array of the piezoelectric elements 45P corresponding to one ejecting port 40N.

The column parts may be formed simultaneously with the formation of the piezoelectric elements 45P by dividing piezoelectric element members (piezoelectric elements 45P). That is, the ejecting head may use the piezoelectric element members as the column parts by not applying voltages to the piezoelectric elements.

In the following, a description is given of inkjet operations (release-push operations) performed by each ejecting head to eject ink from the nozzles 40N.

The ejecting head in this embodiment initially lowers a voltage applied to the piezoelectric element 45P (pressure generating unit 45) from a reference potential to shrink the piezoelectric element 45P in a layered direction of the piezoelectric element 45P. Further, the ejecting head causes the diaphragm 42 to undergo warping deformation by the shrinkage of the piezoelectric element 45P. The ejecting head enlarges (expands) the capacity (volume) of the liquid chamber 40F by the warping deformation of the diaphragm 42. The ejecting head may cause ink to flow from the common liquid chamber C into the liquid chamber 40F in this manner.

Next, the ejecting head raises the voltage applied to the piezoelectric element 45P to expand the piezoelectric element 45P in the layered direction of the piezoelectric element 45P. Further, the ejecting head causes the diaphragm 42 to deform in a nozzle 40N direction by the expansion of the piezoelectric element 45P. The ejecting head enlarges the capacity (volume) of the liquid chamber 40F by the warping deformation of the diaphragm 42. This enables the ejecting head to apply pressure to ink inside the liquid chamber 40F. Further, the ejecting head may be able to eject ink from the ejecting ports 40N by applying the pressure to the ink.

Thereafter, the ejecting head lowers the voltage applied to the piezoelectric element 45P to the reference voltage to move the piezoelectric element 45P back to an initial position. At this time, the ejecting head supplies ink from the common liquid chamber 40C to fill the liquid chamber 40F by expanding the liquid chamber 40F to reduce the pressure inside the liquid chamber 40F. Subsequently, after oscillations of meniscus surfaces of the nozzles 40N are reduced or stabilized, the ejecting head proceeds with next ink ejecting operations to repeat the above-described operations.

Note that a drive method of the ejecting head to be employed by the present embodiment is not limited to the above-described example (release-push operations). Specifically, the drive method of the ejecting head may allow the ejecting head to perform release or push operations by controlling the voltage (drive waveform) applied to the piezoelectric element 45P.

As described above, the image forming apparatus 100 according to the embodiment may be able to form a monochrome or a full color image in an overall image forming region by using the image forming unit 40 (i.e., four ejecting heads 40K, 40C, 40M, and 40Y) to perform one transporting operation of the recording medium (i.e., the roll sheet Md).

Note that the pressure generating unit 45 to be employed by the present embodiment is not limited to the above-described example (the piezoelectric element 45P). Specifically, the pressure generating unit 45 may be a thermal type pressure generating unit configured to generate air bubbles by utilizing a heat element to heat ink inside the liquid chamber as disclosed in Japanese Laid-open Patent Publication No. 61-59911. Further, the pressure generating unit 45 may be an electrostatic type pressure generating unit including a diaphragm and an electrode that are disposed on opposite wall surfaces of the liquid chamber 40F such that the diaphragm undergoes warping deformation by electrostatic force generated between the diaphragm and the electrode as disclosed in Japanese Laid-open Patent Publication No. 6-71882.

Configuration of Posttreatment Unit

The posttreatment unit 50 is configured to posttreat the recording medium on which an image is already formed.

The posttreatment unit 50 posttreats the surface of the roll sheet Md on which the image is formed by the image forming unit 40 with a posttreatment liquid.

Note that the posttreatment indicates ejecting (accumulating) the posttreatment liquid on at least a part (e.g., formed of a spotted shape or a striped shape) of the surface of the roll sheet Md (the recording medium).

Figure 5:
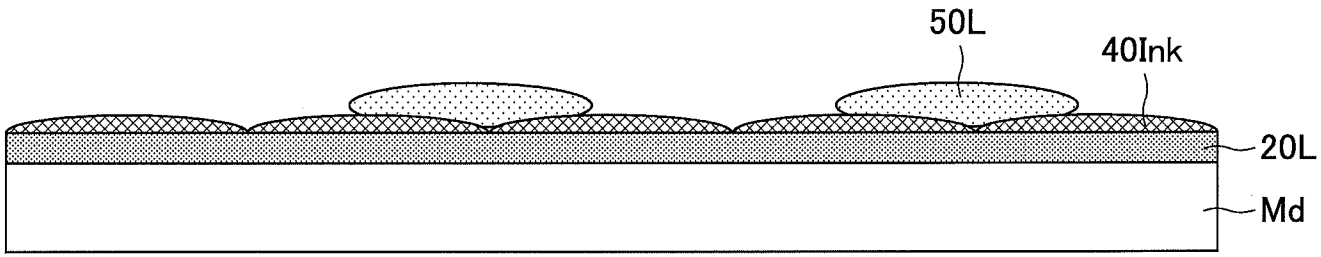
FIG. 5 is an explanatory diagram illustrating an example of a recording medium on which an image is formed by the image forming apparatus according to the first embodiment.

FIG. 5 schematically illustrates a cross-section of the surface of the recording medium after the posttreatment. As illustrated in FIG. 5, the pretreatment liquid 20L to the entire surface of the roll sheet Md, and ink 40Ink to form an image is further ejected (applied) at predetermined positions of the entire surface of the roll sheet Md. The posttreatment unit 50 ejects or applies (accumulates) a posttreatment liquid 50L to the surface of the roll sheet Md on which the image is formed.

Thus, the image forming apparatus 100 according to the embodiment may be able to accumulate or apply (eject) the posttreatment liquid on the surface of the recording medium (the roll sheet Md) on which the image is formed.

As described above, it may be possible to prevent the image on the recording medium from coming (stripping) off the recording medium due to the friction between the surface of the recording medium (i.e., the roll sheet Md) and other objects (e.g., other recording media) by ejecting (applying) or accumulating the posttreatment liquid on the recording medium after the image forming processing is performed on the recording medium.

That is, the image forming apparatus 100 according to the embodiment may be configured to include the posttreatment unit 50 to perform posttreatment to improve rubfastness (abrasion-resistance) of the image formed on the recording medium.

The posttreatment method of the posttreatment unit 50 is not specifically limited to a particular method; however, any one of the posttreatment methods may be selected based on types of the posttreatment liquid. For example, the coating method (application method) for applying the pretreatment liquid employed by the pretreatment unit 20, or the ejecting method for ejecting ink (i.e., inkjet method) employed by the image forming unit 40, that is, the method employing the ejecting head may be used as the posttreatment method of the posttreatment unit 50. Specifically, it is preferable to employ a method similar to the inkjet method employed by the image forming unit 40 as the posttreatment method of the posttreatment unit 50 in view of downsizing the apparatus configuration and preservation stability of the posttreatment liquid. Note that in a case of ejecting or applying the posttreatment liquid, it is preferable that the posttreatment liquid include an appropriate amount of a water-soluble organic solvent (wetting agent) used in the inkjet method employed by the image forming unit 40.

The posttreatment unit 50 may employ a treatment liquid containing a component capable of forming a transparent protection layer on the surface of the roll sheet Md (recording medium) as the posttreatment liquid. Note that the treatment liquid containing a component capable of forming a transparent protection layer may indicate a treatment liquid that contains, for example, a water-dispersible resin (resin), a water-soluble organic solvent (a wetting agent), a penetrant, a surfactant, water and/or optionally contains other components. Further, it is preferable that the posttreatment liquid be a resin composition containing a component polymerized by the application of ultraviolet (UV), and/or thermoplastic resin. Further, it is preferable that the posttreatment liquid be a thermoplastic resin emulsion (water-dispersible resin) to improve glossiness or fixability.

Hence, the posttreatment unit 50 may be able to improve the glossiness of the surface of the roll sheet Md on which an image is formed, and/or protect (cover) the surface of the roll sheet Md with a resin layer.

Note that preferable examples of the water-dispersible resin include acrylic resin, styrene-acrylic resin, urethane resin, acrylic-silicone resin, and fluorocarbon resin. The appropriate one of the above described preferable examples of the water-dispersible resin may be selected based on the water-dispersible resin suitable for the inkjet method employed by the image forming unit 40. Further, a preferable amount of the water-dispersible resin contained in the protection layer may be ranged from 1 to 50 wt % as a solid content. Further, a preferable amount of the water-dispersible resin contained in the protection layer may be ranged from 1 to 30 wt % in a case of using the inkjet method employed by the image forming unit 40.

When the amount of the water-dispersible resin contained in the protection layer exceeds 50 wt %, the viscosity of the posttreatment liquid may be increased. When the amount of the water-dispersible resin contained in the protection layer is less than 1 wt %, energy necessary for evaporating water of the posttreatment liquid may be increased.

The mean particle size (D50) of the water-dispersible resin of the posttreatment liquid is associated with the viscosity of the posttreatment liquid. In a case where compositions are the same, the smaller the particle size of the composition, the greater the viscosity of the posttreatment liquid will be. Hence, it is preferable that the mean particle size (D50) of the water-dispersible resin be 50 nm or greater in order to prevent the posttreatment liquid from having excessive viscosity when the posttreatment is applied.

Further, the mean particle size of the water-dispersible resin of the posttreatment liquid being several tens of micrometers (μm) is not preferable because such a mean particle size is greater than the nozzle diameters of the ejecting head configured to eject or apply the posttreatment liquid. Further, there is a case where the mean particle size of the water-dispersible resin of the posttreatment liquid is smaller than the nozzle diameters but particles having the size larger than the nozzle diameters are present in the posttreatment liquid to degrade the inkjet capability.

Hence, it is preferable that the mean particle size (D50) of the posttreatment liquid (the water-dispersible resin) be preferably 200 nm or less, and it is specifically preferable that the mean particle size of the posttreatment liquid be preferably 150 nm or less.

In a case where the posttreatment liquid contains a water-soluble organic solvent (wetting agent), the water-soluble organic solvent is not particularly limited. Further, it is preferable that the amount of the water-soluble organic solvent contained in the posttreatment liquid may be ranged from 10 to 80 wt %, and it is specifically preferable that the amount of the water-soluble organic solvent be ranged from 15 to 60 wt %.

Note that when the amount of the water-soluble organic solvent contained in the posttreatment liquid exceeds 80 wt %, it may be difficult (slow) to dry the posttreated recording medium. Further, when the amount of the water-soluble organic solvent contained in the posttreatment liquid is less than 10 wt %, the composition of the posttreatment liquid may change due to the posttreatment liquid being mixed with the pretreatment liquid.

The penetrant and surfactant to be used in the posttreatment liquid are not particularly specified. The penetrant and surfactant contained in the pretreatment liquid employed by the pretreatment unit 20 or those contained in the ink employed by the image forming unit 40 may be selected as the penetrant and surfactant to be used in the posttreatment liquid.

Note that the posttreatment liquid may contain other components. For example, the posttreatment liquid may further contain resin, wax, a pH adjuster, a wetting agent, penetrant, a surfactant, an antibacterial agent, a surface modifier, and an antifoaming agent.

Note that an example of the resin may be urethane resin. An example of the resin may be polyethylene wax. An example of the pH adjuster may be 2-amino-2-ethyl-1,3-propanediol. An example of the wetting agent may be 1,3-butadiene. An example of the wetting agent may be glycerine. An example of the penetrant may be 2-ethyl-1,3-hexanediol. An example of the surfactant may be perfluoroalkylpolyethylene oxide addition reactant. An example of the antibacterial agent may contain 1,2-benzisothiazol-3-one as an active ingredient. An example of the surface modifier may be a mixture of polyether modified polydimethylsiloxane and polyether (i.e., polyether modified polydimethylsiloxane). An example of the antifoaming agent may be 2,4,7,9-tetramethyl-4,7-decanediol.

Configuration of Discharge Unit

The discharge unit 60 is configured to discharge the recording medium or the like on which an image is already formed. As illustrated in FIG. 1, the discharge unit 60 in this embodiment is configured to include a storage part 61, plural transport rollers 62, and the like. The discharge unit 60 may cause the transport rollers 62 and the like to store the roll sheet Md on which the image is formed by winding the roll sheet Md around a storage roll.

In this case, as already described above, an appropriate discharge unit may be used based on types of the recording medium.

Configuration of Control Unit

The control unit 70 is configured to control operations of the image forming apparatus 100. The control unit 70 is configured to send operational instructions to elements of the image forming apparatus 100 so as to control operations of the respective elements. Initially, a description is given of the control unit 70 according to the embodiment by referring to FIGS. 6A to 9.

Note that, the image forming apparatus 100 according to the embodiment (the control unit 70) may employ production printing as a printing system. Note that the production printing indicates a manufacturing system capable of efficiently managing jobs or print data so as to conduct a large amount of printing (image formation and printing) in a short time. More specifically, the image forming apparatus 100 according to the embodiment employs separate devices or units to perform a raster image processor (RIP) process to control print operations such as print operations of bitmap data, and a print process based on the bitmap data controlled by the RIP process.

Further, the image forming apparatus 100 according to the embodiment (the control unit 70) may form a workflow system to carry out management from print data creation to distribution of printed matter. That is, the image forming apparatus 100 according to the embodiment may be able to implement higher speed printing by using separate devices to perform the RIP process and the print process.

Figure 6A:
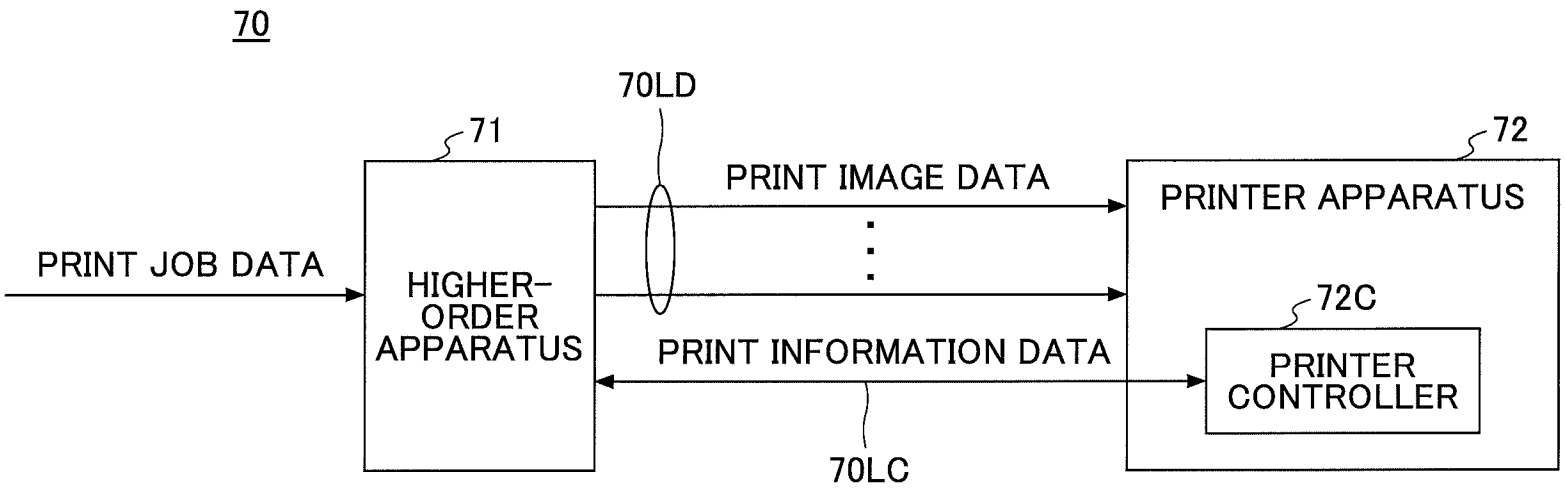
FIGS. 6A and 6B are explanatory diagrams each illustrating examples of a control unit of the image forming apparatus according to the first embodiment.

As illustrated in FIG. 6A, the control unit 70 of the image forming apparatus 100 according to the embodiment includes a higher-level apparatus (i.e., digital front end (DFE)) 71 configured to perform the RIP process, and the like, and a printer apparatus 72 configured to perform the print process and the like. Note that the higher-level apparatus 71 and the printer apparatus 72 are connected to plural data lines 70LD and a control line 70LC.

In the following, a description is given of the higher-level apparatus 71 of the control unit 70 of the image forming apparatus 100 according to the embodiment, and the printer apparatus 72.

Higher-Level Apparatus 71

The higher-level apparatus 71 of the control unit 70 of the image forming apparatus 100 is configured to perform a RIP process based on print job data (i.e., job data, print data) output from a not-illustrated host apparatus. That is, the higher-level apparatus 71 according to the embodiment is configured to create bitmap data (hereinafter referred to as "print image data") corresponding to different colors based on the print job data.

Further, the higher-level apparatus 71 according to the embodiment is configured to create data (hereinafter referred to as "control information") for controlling print operations based on the print job data and information on the host apparatus. Note that the control information includes data associated with a print conditions (information on a print form, a print type, feed-discharge information, a print surface order, a print paper size, a data size of print image data, resolution, paper-type information, gradation, color information, and the number of pages to be printed).

The print image data of different colors created by the higher-level apparatus 71 are supplied to a not-illustrated printer engine part of the printer apparatus via the plural data lines 70LD.

Further, the controller 71 is configured to send control information to set the print conditions to a printer controller 72C via the control line 70LC.

When the printer controller 72C receives the control information, various types of the print conditions contained in the received control information may be written in a register, or the like of the later-described print control part 72Cc to set the print conditions. Then, the controller 71 controls the printer engine part to perform printing based on the print jobs.

Figure 6B:
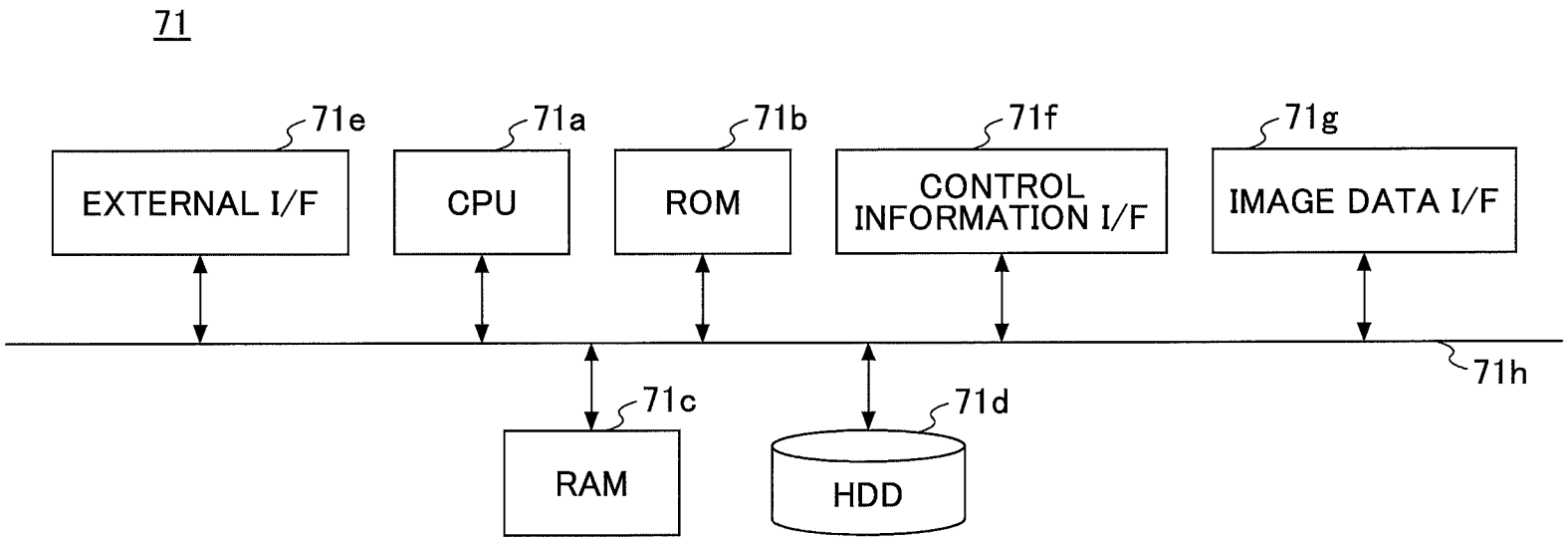

As illustrated in FIG. 6B, the higher-level apparatus 71 in this embodiment is configured to include a central processing unit (CPU) 71*a*, a read only memory (ROM) 71*b*, a random access memory (RAM) 71*c*, and a hard disk drive (HDD) 71*d*. In addition, the higher-level apparatus 71 is configured to further include an external interface (I/F) 71*e*, a control information I/F 71*f*, and an image data I/F 71*g*. Moreover, the higher-level apparatus 71 is configured to still further include a bus 71*h* for connecting the above elements. The higher-level apparatus 71 has a configuration to allow the CPU 71*a* and the like to communicate (perform transmission/reception) with one another.

The CPU 71*a* is configured to control overall operations of the higher-level apparatus 71 utilizing a control program and the like stored in the ROM 71*b* and/or the HDD 71*d*.

The ROM 71*b*, RAM 71*c*, and HDD 71*d* are respective devices configured to store data, and the like. The ROM 71*b* and the HDD 71*d* are configured to store the control program for controlling the CPU 71*a* in advance, as illustrated above. The RAM 71*c* is configured to serve as a work area of the CPU 71*a*.

The external I/F 71*e* is configured to control communications (transmissions and receptions) with an external apparatus (e.g., a host apparatus) of the image forming apparatus 100. The external I/F 71*e* may, for example, be configured to control communications corresponding to transmission control protocol/Internet protocol (TCP/IP).

The external I/F 71*e* is configured to control communications (transmissions and receptions) of the control information. The control information I/F 71*f* is not particularly specified; however, a peripheral component interconnect bus (PCI Express) may be used.

The image data I/F 71*g* is configured to control communications (transmissions and receptions) of the print image data. The image data I/F 71*g* may need higher transfer rates, and hence, the PCI Express may be used for the image data I/F 71*g*. The image data I/F 71*g* in this embodiment include plural channels. Hence, as will be described later, the print image data of the different colors created by the higher-level apparatus 71 are output from respective channels corresponding to the different colors of the print image data.

The higher-level apparatus 71 according to the embodiment allows the external I/F 71*e* to receive the print job data transmitted from the host apparatus, and then allows the HDD 71*d* to store the received print job data via the CPU 71*a*. Further, the higher-level apparatus 71 performs the RIP process based on the print job data retrieved from the HDD 71*d* utilizing the CPU 71*a* to generate bitmap data of different colors (yellow (Y), cyan (C), magenta (M), and black (B)), and then stores the generated bitmap data of the different colors in the RAM 71*c*. The higher-level apparatus 71 (CPU 71*a*) may, for example, generate the bitmap data of the different colors by using a page description language (PDL) and write the generated bitmap data of the different colors into the RAM 71*c*.

Subsequently, the higher-level apparatus 71 performs compression coding on the bitmap data of the different colors written in the RAM 71*c*, and then temporarily stores the compression-coded bitmap data in the HDD 71*d*.

Thereafter, when the printer apparatus 72 starts print operations, the higher-level apparatus 71 (the CPU 71*a*) retrieves the compression-coded bitmap data of the different colors from the HDD 71*d*, decodes the compression-coded bitmap data, and writes the decoded bitmap data of the different colors into the RAM 71*c*. Subsequently, the higher-level apparatus 71 retrieves the bitmap data of the different colors from the RAM 71*c*, and outputs the retrieved bitmap data to the printer apparatus 72 (i.e., the later-described printer engine 72E) as the print image data via the respective channels (i.e., data lines 70LD-Y, 70LD-C, 71LD-M, and 71LD-K in FIG. 7) of the image data I/F 71*g*.

Further, the higher-level apparatus 71 according to the embodiment performs transmission and reception of the control information between the higher-level apparatus 71 and the printer apparatus 72 (the later-described printer controller 72C) using the CPU 71*a* via the control information I/F 71*f* (the control line 70LC) based on the progress of the print operations, and the like.

Further, when the printer apparatus 72 starts the posttreatment process, the higher-level apparatus 71 according to the embodiment retrieves the compression-coded image data associated with the posttreatment process from the HDD 71*d*, and outputs the retrieved image data to the printer apparatus 72 (the printer engine 72E) via the data line 70LD-P (see FIG. 7) in a manner similar to the above bitmap data.

Printer Apparatus 72

The printer apparatus 72 of the control unit 70 of the image forming apparatus 100 according to the embodiment is configured to control operations to form images on the recording medium based on the print image data input from the higher-level apparatus 71 and the control information.

Figure 7:
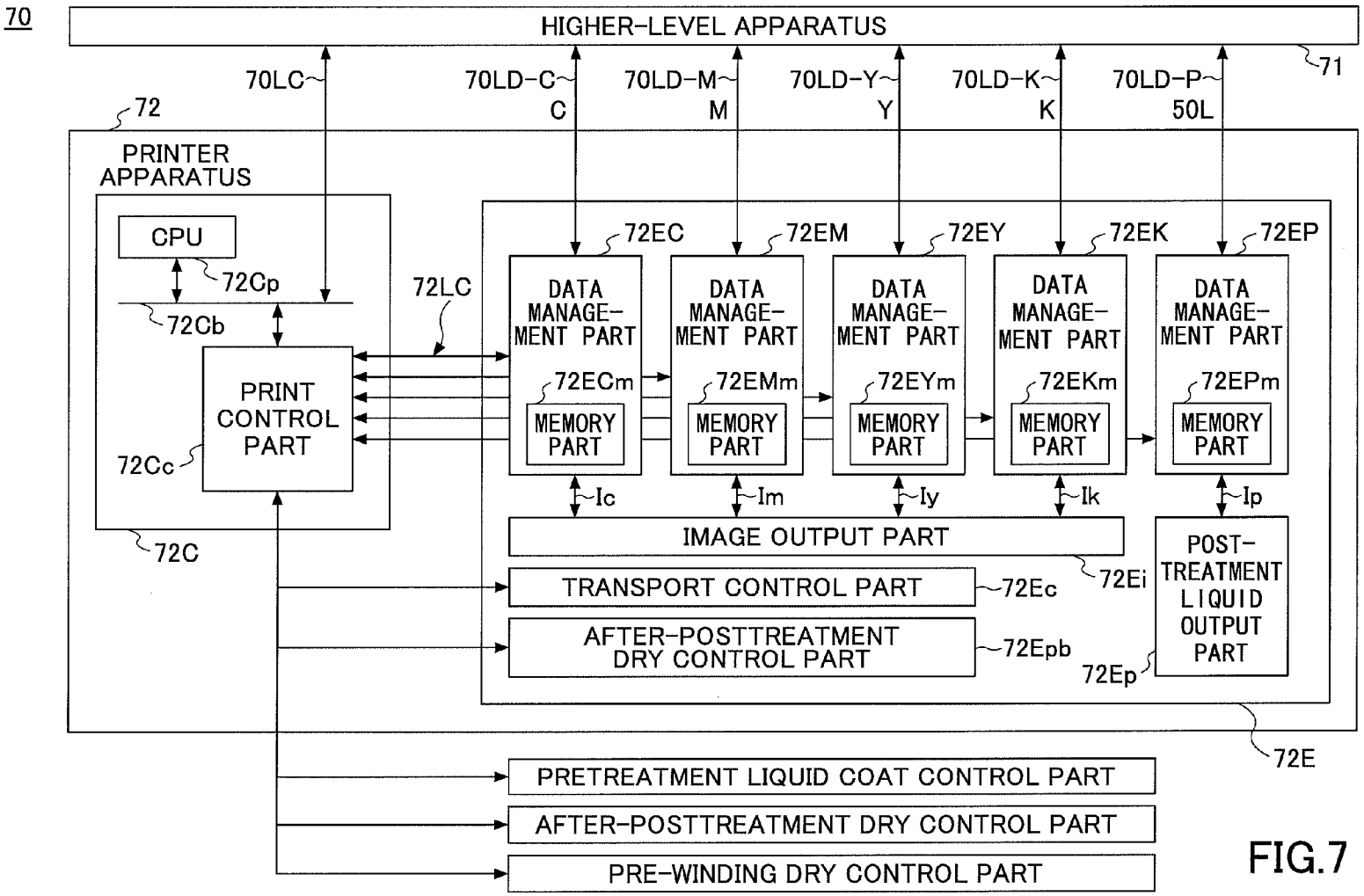
FIG. 7 is a functional block diagram illustrating examples of functions operated by the control unit of the image forming apparatus according to the first embodiment.

As illustrated in FIG. 7, the printer apparatus 72 in this embodiment is configured to include the printer controller 72C, and a printer engine 72E.

The printer controller 72C is configured to control operations of the later-described printer engine 72E. The printer controller 72C performs transmission and reception of the control information, and the like between the higher-level apparatus 71 and the printer controller 72C via the control line 70LC. Further, the printer controller 72C performs transmission and reception of the control information, and the like between the higher-level apparatus 72 and the printer controller 72C via the control line 70LC. Accordingly, when the printer controller 72C receives the control information, the printer controller 72C writes various types of the print conditions contained in the received control information into a register, or the like of the print control part 72Cc to store the print conditions. Further, the printer controller 72C controls the printer engine 72E based on the control information to execute printing according to print job data (the control information).

As illustrated in FIG. 7, the printer controller 72C in this embodiment is configured to include a CPU 72Cp, and a print control part 72Cc. Further, the printer controller 72C is configured to connect the CPU 72Cp and the print control part 72Cc via a bus 72Cb such that the CPU 72Cp and the print control part 72Cc may be able to communicate with each other. Note that the bus 72Cb is connected to the control line 70LC via a not-illustrated communication I/F.

The CPU 72Cp is configured to control overall operations of the printer apparatus 72 utilizing a control program and the like stored in a not-illustrated ROM. The print control part 72Cc performs transmission and reception of command and status information between the print control part 72Cc and the printer engine 72E based on the control information received from the higher-level apparatus 71. Hence, the print control part 72Cc may be able to control operations of the printer engine 72E.

The printer engine 72E is configured to control operations to form images on the recording medium based on the print image data input from the higher-level apparatus 71 and the control information input from the printer controller 72C. Further, the printer engine 72E in this embodiment is also configured to control operations to posttreat the recording medium based on the print image data input from the higher-level apparatus 71 and the control information input from the printer controller 72C.

The printer engine 72E is connected with the plural data lines 70LD (data lines 70LD-C, 70LD-M, 70LD-Y, 70LD-K, and 70LD-P in FIG. 7). The printer engine 72E receives print image data from the higher-level apparatus 71 via the plural data lines 70LD-C, and the like. The printer engine 72E then implements print operations of different colors, and posttreatment with a posttreatment liquid based on the received print image data in compliance with the control of the printer controller 72C.

As illustrated in FIG. 7, the printer engine 72E in this embodiment is configured to include plural data management parts 72EC, 72EM, 72EY, 72EK, and 72EP. Moreover, the printer engine 72E in this embodiment is configured to further include an image output part 72Ei configured to receive the print image data and the like output from the data management parts 72EC, and the like, and a transport control part 72EC configured to control transportation of the recording medium. In addition, the printer engine 72E in this embodiment is configured to still further include a posttreatment liquid output part 72Ep configured to receive the image data associated with the posttreatment process output from the data management part 72EP, and an after-posttreatment dry control part 72Epb configured to control operations of the posttreatment dry part 32 (FIG. 1) after the posttreatment.

Note that the posttreatment liquid may further include a pretreatment coat control part, an after-pretreatment dry control part (unit), and a pre-winding dry control part.

In the following, a description is given of a configuration of the data management part 72EC with reference to FIG. 8. Note that configurations of other data management part 72EM, 72EY, 72EK, and 72EP are similar to the configuration of the data management part 72EC, and hence, duplicated illustrations of such configurations will be omitted from the specification.

Figure 8:
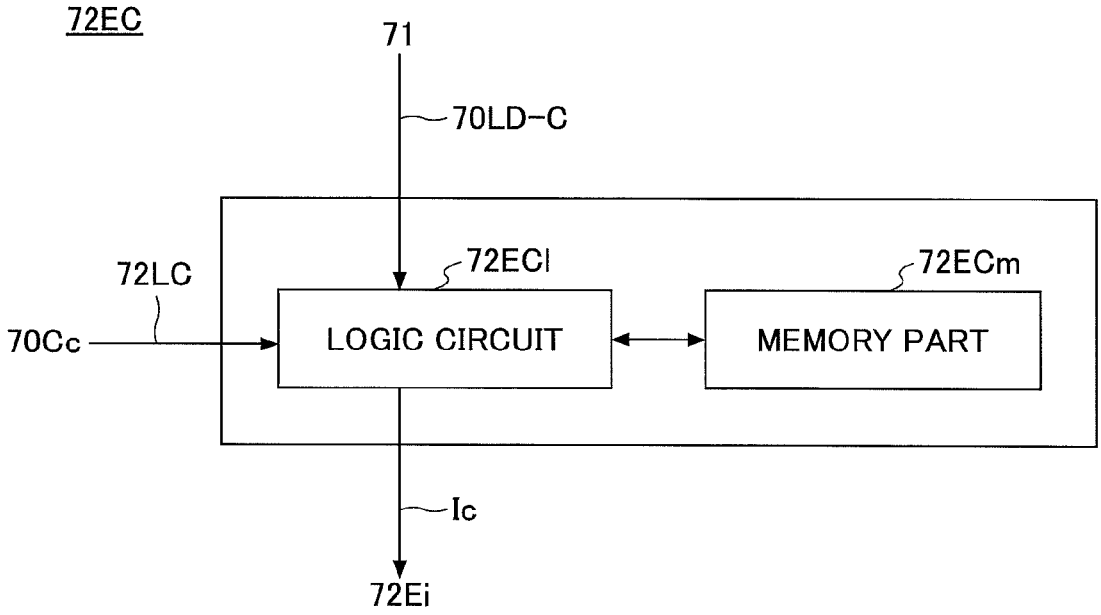
FIG. 8 is a functional block diagram illustrating an example of a data management part of the control unit of the image forming apparatus according to the first embodiment.

As illustrated in FIG. 8, the data management part 72EC is configured to include a logic circuit 72ECl, and a memory part 72ECm. The data management part 72EC (logic circuit 72ECl) is connected to the higher-level apparatus 71 via the data line 70LD-C. Further, the data management part 72EC (logic circuit 72ECl) is connected to the printer controller 72C (the print control part 72Cc) via the control line 70LC.

The logic circuit 72ECl in this embodiment is configured to store the print image data output from the higher-level apparatus 71 in the memory part 72ECm based on the control signal output from the printer controller 72C (i.e., the print control part 72Cc). Further, the logic circuit 72ECl is configured to read the print image data Ic (see FIG. 7) corresponding to cyan (C) from the memory part 72ECm based on the control signal output from the printer controller 72C (i.e., the print control part 72Cc), and to output the read print image data Ic into the image output part 72Ei. Note that in a case of a logic circuit 72ECp (i.e., a data management part 72EP), the logic circuit 72ECp is configured to output data Ip (FIG. 7) associated with the posttreatment into the posttreatment liquid output part 72Ep.

Note that the memory part 72ECm may be configured to include capacity capable of holding print image data of at least three pages. The print image data of three pages may correspond to print image data of a page being transferred from the higher-level apparatus 71, print image data of a page currently being output, and print image data of a next page.

Note that the data management part 72EC may employ a hardware logic circuit composed of a combination of logic circuits, and the like. Hence, the data management part 72EC may be able to achieve a higher rate process. Further, the data management part 72EC may, for example, allow the logic circuit 72ECl to perform a logical operation with respect to the control signal utilizing a bit string to determine an appropriate one of processes to be executed.

The print image data of the different colors and the posttreatment liquid respectively output from the data management part (72EC, etc.) are supplied to the image output part 72Ei and the posttreatment liquid output part 72Ep. The image output part 72Ei is configured to execute printing based on the print image data of the different colors. Further, the posttreatment liquid output part 72Ep is configured to execute printing based on the print image data of the posttreatment liquid.

In the following, a description is given of a configuration of the image output part 72Ei with reference to FIG. 9. Note that the configuration of the posttreatment liquid output part 72Ep is basically similar to that of the image output part 72Ei. Hence, a description of the configuration of the posttreatment liquid output part 72Ep is omitted from the specification.

Figure 9:
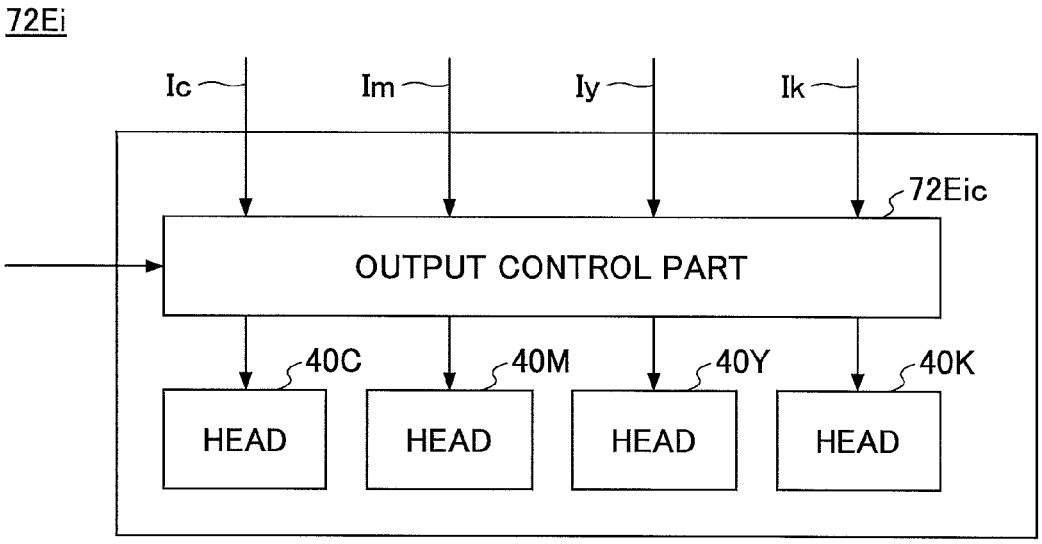
FIG. 9 is a functional block diagram illustrating an example of an image output part of the control unit of the image forming apparatus according to the first embodiment.

As illustrated in FIG. 9, the image output part 72Ei is configured to include an output control part 72Eic, and the ejecting heads 40C, 40M, 40Y, and 40K of respective colors.

The output control part 72Eic is configured to output the print image data of different colors to the ejecting heads 40C, 40M, 40Y, and 40K (see FIG. 3) of corresponding colors. That is, the output control part 72Eic may be able to control operations of the ejecting heads 40C, and the like, based on the print image data.

That is, the output control part 72Eic may be able to control two or more ejecting heads 40C, and the like, independently. That is, the output control part 72Eic may control two or more ejecting heads 40C, and the like, simultaneously, based on the supplied print image data (e.g., "Ic" in FIG. 9). Further, the output control part 72Eic may control the ejecting heads 40C, and the like, based on the control signal input from a not-illustrated control device. In addition, the output control part 72Eic may control the ejecting heads 40C, and the like, based on the user's operational input.

In the printer apparatus 72 according to the embodiment, the print image data from the higher-level apparatus 71 are transferred via a path differing from a path via which the control information to control the printing based on the print image data is transmitted or received between the higher-level apparatus 71 and the printer apparatus 72.

Further, in the printer apparatus 72 according to the embodiment, the print image data of the different colors output from the higher-level apparatus 71 are transferred via the different data lines 70LD-C, and the like, and the print image data of the different colors transferred via the different data lines 70LD-C, and the like, are independently controlled; and then the independently controlled print image data of the different colors are supplied to the data management parts 72EC, and the like having a common configuration. Further, in the image output part 72Ei, connecting paths of the outputs of the data management parts 72EC, and the like and the ejecting heads 40C, and the like of the different colors may be configured to be settable by the user's operation.

Hence, the printer apparatus 72 according to the embodiment may control the print image data of the different colors independently of one another. Further, the printer apparatus 72 may be able to simply change the configuration of the printer engine 72E, based on the number of colors (e.g., four colors C, M, Y, and K, or a single color K alone) of the print image data, or the number of the ejecting heads. That is, the image forming apparatus 100 (the printer apparatus 72) according to the embodiment may be an exhibit downsizing apparatus effect and a cost reduction effect by selectively incorporating necessary data management parts 72EC, and the like, and necessary ejecting heads 40C, and the like.

For example, when printing full color images with four colors such as C, M, Y, and K, the image forming apparatus 100 (the printer apparatus 72) according to the embodiment may be able to incorporate all the data management parts 72EC, and the like into the printer engine 72E. In this configuration, the image forming apparatus 100 (the printer apparatus 72) may be able to connect the outputs of the data management parts 72EC, and the like to the corresponding ejecting heads 40C, and the like, utilizing the output control part 72Eic.

Further, when printing single color images with a color such as K for prioritizing the apparatus cost, the image forming apparatus 100 (the printer apparatus 72) may be able to incorporate one data management part 72EK, and one ejecting head 40K into the printer engine 72E. In this configuration, the image forming apparatus 100 (the printer apparatus 72) may be able to connect the output of the data management part 72EK to the corresponding ejecting head 40K, utilizing the output control part 72Eic.

Further, when printing single color images with a color such as K for prioritizing printing speeds, the image forming apparatus 100 (the printer apparatus 72) may be able to incorporate one data management part 72EK, and four ejecting heads into the printer engine 72E. In this configuration, the image forming apparatus 100 (the printer apparatus 72) may be able to connect the output of the data management part 72EK to each of the four ejecting heads, utilizing the output control part 72Eic. In this case, the image forming apparatus 100 (the printer apparatus 72) may be able to perform printing by superposing the same color (i.e., K) plural times, which may achieve four times faster printing (image formation) than printing performed by one ejecting head.

Applying Amount Control of Pretreatment Liquid, Ejecting Amount Control of Posttreatment Unit, and Drying Strength Control of Dry Unit The pretreatment unit 20 in this embodiment is configured to control an applying amount of the pretreatment liquid, based on the resolution of the image to be formed on the recording medium. Likewise, the posttreatment unit 50 is configured to control an ejecting (applying) amount of the posttreatment liquid, based on the resolution of the image to be formed on the recording medium. In addition, a dry unit to dry the image and the posttreatment liquid formed on the recording medium, that is, the dry unit 32, is configured to control drying strength, based on the resolution of the image to be formed on the recording medium.

Initially, the pretreatment unit 20 is illustrated. As illustrated above, an ink dot diameter may vary with the resolution of the image to be formed on the recording medium to change a drying velocity of the images. For example, in a case of recording low resolution images, ink dot diameters to be formed on the recording sheet tend to be large compared to a case of recording high resolution images. As a result, it may take a longer time to dry the ink due to the greater ratio of surface to ink volume for each of the dots. Further, a recording velocity is higher in printing the low resolution images than the high resolution images, which may result in taking a longer time to dry the ink. This indicates low permeability, which may cause ink spreading or ink beading.

As noted earlier, an appropriate amount of the pretreatment liquid may vary with the resolution of the image to be formed on the recording medium. Hence, an appropriate amount of the pretreatment liquid on the surface of the recording medium may be applied based on the resolution of the image to be formed on the recording medium to suppress the beading from occurring, which may improve the image quality.

Specifically, it may be preferable that the pretreatment unit increase the applying amount of the pretreatment liquid along with a decrease in the resolution of the image to be formed on the surface of the recording medium. Specifically, it may be preferable that the pretreatment unit decrease the applying amount of the pretreatment liquid along with an increase in the resolution of the image to be formed on the surface of the recording medium.

In this case, the amount of the pretreatment liquid applied on the surface of the recording medium is controlled based on the resolution of the image to be formed on the recording medium. Hence, in a case where the pretreatment dry unit (pretreatment dry part) 31 is disposed, it may be preferable to control the drying strength of the dry unit.

Specifically, it may be preferable that the pretreatment dry unit (pretreatment dry part) 31 increase the drying strength along with a decrease in the resolution of the image to be formed on the surface of the recording medium. Similarly, it may be preferable that the pretreatment dry unit (pretreatment dry part) 31 decrease the drying strength along with an increase in the resolution of the image to be formed on the surface of the recording medium.

Further, it may be preferable that the pretreatment dry unit (pretreatment dry part) 31 increase the drying strength along with an increase in the applying amount of the pretreatment liquid.

With this configuration, the shrinkage of the sheet (recording medium) due to the insufficient dryness of the recording medium or excessive dryness of the recording medium may be controlled while the pretreatment dry unit dries the pretreatment liquid on the recording medium. Hence, it may be possible to form (print) the image stably, and apply the posttreatment liquid stably.

Specifically, in a case where the image to be formed on the recording medium is high resolution, the number of dots to be formed is increased, and the time required for forming an image is thus increased. Accordingly, the transporting velocity of the recording medium may need decreasing. As illustrated in FIG. 1, the pretreatment dry unit (the pretreatment dry part) 31 and the image forming unit 40 are disposed in the same line. Hence, when the transporting velocity of the recording medium is lowered, the time required for the recording medium to pass through the pretreatment dry unit (the pretreatment dry part) 31 may be increased. Thus, it may be possible to suppress the shrinkage of the sheet (recording medium) caused by the excessive dryness of the recording medium by controlling the drying strength of the pretreatment dry part 31.

Next, the posttreatment unit 50 is illustrated. As already described above, it may be possible to prevent the image on the recording medium from coming (stripping) off the recording medium due to the friction between the surface of the recording medium (i.e., the roll sheet Md) and other objects (e.g., other recording media) by ejecting (applying) or accumulating the posttreatment liquid on the recording medium after the image forming processing is performed on the recording medium, as well as improving the glossiness of the recording medium.

That is, when the image forming apparatus 100 according to the embodiment includes the posttreatment unit 50, it may be possible to improve rubfastness (abrasion-resistance) of the image formed on the recording medium, as well as improving the glossiness of the recording medium.

However, when the posttreatment liquid is uniformly applied to the image formed on the surface of the recording medium regardless of the resolution of the image, a longer time may be required for applying (ejecting) the posttreatment liquid.

Specifically, in a case where an image to be formed on the recording medium is high resolution, sizes of the dots to be formed will be decreased. This indicates that the adhesiveness between the ink forming an image and the recording medium is enhanced. Hence, even though the ejecting (applying) amount of the posttreatment liquid is small, it may be possible to acquire sufficient rubfastness (abrasion-resistance) of the image formed on the recording medium.

Hence, it may be possible to decrease the time required for the posttreatment by ejecting (applying) the posttreatment liquid to the recording medium based on the resolution of the image to be formed on the surface of the recording medium, as described above.

In addition, the above case is preferable because the image forming apparatus 100 according to the embodiment is capable of lowering the amount of the posttreatment liquid required for the posttreatment. Further, the above case is also preferable because the image forming apparatus 100 according to the embodiment is capable of reducing the cost required for the posttreatment.

Further, the posttreatment unit 50 may apply the posttreatment liquid either over the entire image formed area of the roll sheet (recording medium) Md, or to (at least) a specific part of the image formed area of the roll sheet (recording medium) Md. However, it may be preferable to accumulate (eject/apply) the posttreatment liquid only to the specific part of the image formed area of the roll sheet (recording medium) Md.

Hence, in a case where the posttreatment liquid is applied by using the ejecting head (recording head), it may be particularly preferable to apply a desired amount of the posttreatment liquid only to the specific part of the image formed area of the roll sheet (recording medium) Md, as a method for applying the posttreatment liquid.

Examples of the specific area to which the posttreatment liquid is applied may include (1) an entire image printable area, (2) an entire image area, (3) an image formed area alone, and (4) an area slightly larger than the image formed area. In any of the above (1) to (4) cases, the posttreatment liquid may be applied to a desired area based on a determined applying amount (application ratio) of the posttreatment liquid. That is, the posttreatment liquid may be applied with respect to at least the image formed area based on a predetermined ratio of the posttreatment liquid so as to protect the image formed on the recording medium.

A method for selecting the application area of the posttreatment liquid may be determined based on the image data. For example, in a case of a solid image, (1) the entire image printable area is selected, whereas in a case of an image having a lot of spaces, (3) the image formed area alone is selected as the application area of the posttreatment liquid. The application area of the posttreatment liquid may be selected based on the print duty (print ratio), or the amount of ejected ink. It may be possible to create a database of the above-described data in advance, compute the print duty (print ratio) or the ejecting amount of ink based on the input information, that is, the image data, and determine the application area of the posttreatment liquid by referring to the database.

When controlling the amount of the posttreatment liquid to be ejected or applied (i.e., the ejecting amount, the applying amount) based on the resolution of the image to be formed on the surface of the recording medium, it may be preferable that the posttreatment unit 50 select or control the above-described ejecting area based on the resolution of the image to be formed on the surface of the recording medium.

Further, as will be described later, it may be preferable to control the amount of the posttreatment liquid to be ejected or applied based on the type of the recording medium; however, it may also be preferable to select or control the above-described ejecting area based on the type of the recording medium.

Thus, the time required for the posttreatment may further be reduced by applying the posttreatment liquid to the specific part of the image formed area, compared to the case where the posttreatment liquid is applied over the entire surface of the recording medium. Further, the above case is preferable because the image forming apparatus 100 according to the embodiment is capable of lowering the amount of the posttreatment liquid required for the posttreatment. In addition, the above case is also preferable because the image forming apparatus 100 according to the embodiment is capable of reducing the cost required for the posttreatment.

Note that it is preferable that the posttreatment unit 50 have the setting of the coating (depositing) amount of the dried posttreatment liquid in a range of 0.5 to 10 g/m$^2$. It is particularly preferable that the posttreatment unit 50 have the setting of the coating (depositing) amount of the dried posttreatment liquid in a range of 2 to 8 g/m$^2$. This is because when the coating (depositing) amount of the dried posttreatment liquid is less than 0.5 g/m$^2$, the image quality (i.e., the image density, hue, glossiness, and the stability) may be degraded. Further, when the coating (depositing) amount of the dried posttreatment liquid exceeds 10 g/m$^2$, the dryness of the protection layer (i.e., the posttreatment liquid) may be lowered; that is, a longer time may be required for drying the protection layer (the posttreatment liquid). In addition, when the coating (depositing) amount of the dried posttreatment liquid exceeds 10 g/m$^2$, the effect of the improved image quality obtained by the saturated application of the posttreatment liquid may be to degrade the economical effect.

Next, the posttreatment dry unit (posttreatment dry part) 32 is illustrated. As already described above, when the coating amount of the pretreatment liquid and the discharging amount of the posttreatment liquid are differentiated based on the resolution of the image to be formed on the recording medium, the following adverse effects may be obtained after the drying process. That is, after the drying process, the recorded sheet may shrink due to insufficient dryness when the amounts of the pretreatment liquid and the posttreatment liquid are large, and the recorded sheet may shrink due to excessive dryness when the amounts of the pretreatment liquid and the posttreatment liquid are small.

Thus, as already described above, it may be possible to appropriately dry the recording medium by controlling the drying strength of the dry unit based on the resolution of the image to be formed on the recording medium.

Further, in a case where the image to be formed on the recording medium is high resolution, the number of dots to be formed is increased, and the time required for forming an image is thus increased. Accordingly, the transporting velocity of the recording medium may need decreasing. As illustrated in FIG. 1, the posttreatment dry unit (the pretreatment dry part) 32 and the image forming unit 40 are disposed in the same line. Hence, when the transporting velocity of the recording medium is lowered, the time required for the recording medium to pass through the posttreatment dry unit (the pretreatment dry part) 32 may be increased. Thus, it may be possible to suppress the shrinkage of the sheet (recording medium) caused by the excessive dryness of the recording medium by controlling the drying strength of the posttreatment dry unit (the pretreatment dry part) 32.

As the resolution of the image to be formed on the recording medium serving as a parameter of controlling the applying amount of the pretreatment liquid, the ejecting (applying) amount of the posttreatment liquid, and the drying strength of the dry unit, the resolution of the image transmitted from the higher-level apparatus 71 (see FIG. 7) to the print control part 72Cc may be used.

The applying amount of the pretreatment liquid, and the ejecting (applying) amount of the posttreatment liquid may be determined by the following methods. That is, a predetermined applying amount of the pretreatment liquid, and a predetermined ejecting amount of the posttreatment liquid corresponding to the resolution of each of the images may be stored in memory in advance, and the applying amount of the pretreatment liquid, and the ejecting amount of the posttreatment liquid may be determined by retrieving the predetermined data from the memory when printing. Alternatively, the applying amount of the pretreatment liquid, and the ejecting amount of the posttreatment liquid may be determined by a user via a predetermined user interface (UI).

As a method of controlling the applying amount of the pretreatment liquid when applying the pretreatment liquid to the recording medium, the roll coating illustrated in FIG. 2 may be employed. The pretreatment unit employing the roll coating may be able to adjust (control) the nip pressure, or the rotational speed of the coating roller or the platen roller while applying the pretreatment liquid based on the resolution of the image to be formed on the recording medium.

As a method of controlling the ejecting amount of the posttreatment liquid when applying the posttreatment liquid to the recording medium, the above-described ejecting head (i.e., the recording head) may be used for controlling the ejecting amount (applying amount) and the ejecting area (applying area) of the posttreatment liquid.

Further, similar to the pretreatment unit, the posttreatment unit may employ the roll coating. The posttreatment unit employing the roll coating may be able to adjust (control) the nip pressure, or the rotational speed of the coating roller or the platen roller while applying the posttreatment liquid based on the resolution of the image to be formed on the recording medium.

Note that the area to which the posttreatment liquid is ejected (applied) may be selected as described above. Hence, it is preferable to use the ejecting head (the recording head) to eject the posttreatment liquid with respect to the recording medium.

The drying strength of the dry unit may be determined by methods similar to the methods of determining the applying amount of the pretreatment liquid, and the ejecting amount of the posttreatment liquid. That is, a predetermined drying strength of the dry unit corresponding to the resolution of each of the images may be stored in memory in advance, and the drying strength of the dry unit may be determined by retrieving the predetermined data from the memory when printing. Alternatively, the drying strength of the dry unit may be determined by a user via a predetermined user interface (UI).

The method of controlling the drying strength of the dry unit is not specifically limited, and may be selected based on the dry unit.

Figure 10:
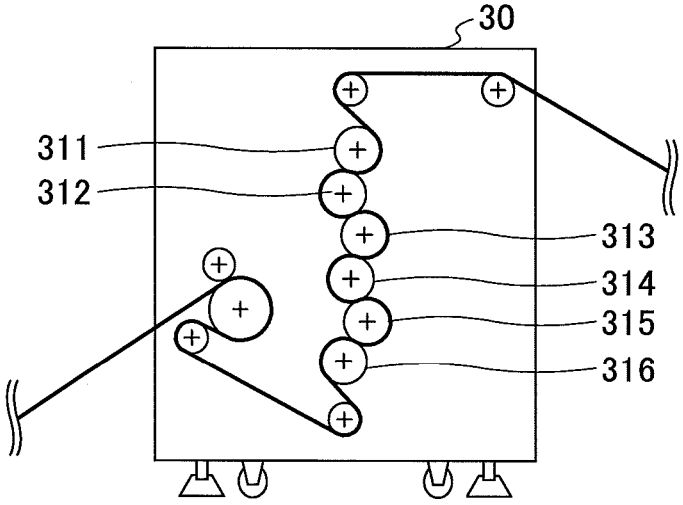
FIG. 10 is a schematic configuration diagram illustrating an example of a dry unit of the image forming apparatus according to the first embodiment.

In the following, a description is given of an example of the dry unit employing heat rollers. As illustrated in FIG. 10, it is preferable to dispose heat rollers 311 to 316 in multiple stages to control the drying strength of the dry unit 30. To lower the drying strength in the configuration of the dry unit described above, the temperatures of the heat rollers may be lowered. For example, the temperatures of the heat rollers may be lowered approximately to 40 to 80° C. Alternatively, only the heat rollers 311 and 312 may be heated and other heat rollers 313 to 316 may be unheated to lower the drying strength of the dry unit 30. In this method, the drying strength of the dry unit 30 may be reduced by decreasing the number of heated heat rollers.

To increase the drying strength in the configuration of the dry unit 30 described above, the temperatures of the heat rollers may be increased. For example, the temperatures of the heat rollers may be increased approximately to 60 to 100° C. Alternatively, the heat rollers 311, 312, 315 and 316 may be heated, or all the heat rollers 311 to 316 may be heated to increase the drying strength of the dry unit 30. In this method, the drying strength of the dry unit 30 may be increased by increasing the number of heated heat rollers.

Note that in the above examples, the drying strength of the dry unit 30 is controlled by adjusting the temperatures of the heat rollers and the number of the heated heat rollers. However, the drying strength of the dry unit 30 may be controlled by adjusting either the temperatures of the heat rollers or the number of the heated heat rollers.

As described above, it is possible to control the drying strength of the dry unit 30 by a combination of the adjustment of the temperatures of the heat rollers and the adjustment of the number of the heated heat rollers.

Thus, it may be preferable that the posttreatment unit increase the ejecting amount of the posttreatment liquid, and that the posttreatment dry unit (the posttreatment dry part 32) increase the drying strength, along with a decrease in the resolution of the image to be formed on the surface of the recording medium when the applying amount of the pretreatment, the ejecting amount of the posttreatment liquid, and the drying strength is controlled.

Further, it may be preferable that the posttreatment unit decrease the ejecting amount of the posttreatment liquid, and that the posttreatment dry unit (the posttreatment dry part 32) decrease the drying strength, along with an increase in the resolution of the image to be formed on the surface of the recording medium.

With these methods and configurations, since the posttreatment liquid may be ejected by adjusting the ejecting amount based on the resolution of the image to be formed on the surface of the recording medium, it may be possible to reduce the time required for the posttreatment. Further, with the above methods and configurations, it may be possible to reduce the amount of the posttreatment liquid required for the posttreatment and hence to reduce the cost.

Further, with these methods and configurations, since the drying strength of the dry unit is controlled simultaneously with the applying amount of the pretreatment liquid, and the ejecting amount of the posttreatment liquid, it may be possible to additionally control the shrinkage of the recording medium due to the insufficient dryness of the recording medium or excessive dryness of the recording medium.

Further, it may be preferable that the posttreatment unit and the dry unit perform their controls based on the type of the recording medium.

Note that examples of the controls based on the type of the recording medium include the control of the applying amount of the posttreatment liquid or the control of the drying strength based on the permeability of the recording medium or the properties such as the thickness and the like. Hence, the types of the recording medium not only include classification such as high-quality paper, recycled paper, thick paper, coated paper, and the like, but also include types classified by specific manufacturers or product names.

For example, when thick paper is used as the recording medium, absorption (absorptive amount) of the recording medium is increased. Hence, it may be preferable that the posttreatment unit increase the applying amount of the posttreatment liquid in order to sufficiently enhance (increase) rubfastness (abrasion-resistance). In this case, when the applying amount of the posttreatment liquid is increased, the time required for drying the thick paper may be increased. Hence, it may be preferable that the dry unit increase the drying strength.

In addition, when the recording medium having high permeability is used, the recording medium tends to absorb the posttreatment liquid more than the standard recording medium does. Hence, it is preferable that the applying amount of the posttreatment liquid be increased, and it is preferable that the dry unit increase the drying strength based on the increased applying amount of the posttreatment liquid.

As described above, a more appropriate amount of the posttreatment liquid may be applied to the surface of the recording medium to keep the surface at an optimal condition before the printing process by controlling the posttreatment unit and the dry unit based on the type of the recording medium in addition to the resolution of the image to be formed on the surface of the recording medium. Accordingly, it may be possible to reduce the time required for the posttreatment, to reduce the amount of the posttreatment liquid required for the posttreatment, and to reduce the cost while maintaining sufficient rubfastness (abrasion-resistance) and glossiness of the image formed on the recording medium.

In addition, it may be possible to suppress the shrinkage of the recording medium due to the insufficient dryness of the recording medium or excessive dryness of the recording medium.

Note that in this case, it may be possible that the pretreatment unit performs its control based on the type of the recording medium in a similar manner as the posttreatment unit. With this configuration and method, it may be possible to further suppress beading so as to improve the image quality. Further, in the case where the pretreatment unit performs its control based on the type of the recording medium, and the pretreatment unit includes the pretreatment dry unit (the pretreatment dry part) 31 to dry the pretreatment liquid, it may be preferable to control the pretreatment dry unit (the pretreatment dry part) 31 based on the type of the recording medium.

A method of controlling the posttreatment unit 50 and the posttreatment dry unit (the posttreatment dry part) 32 is as follows. Initially, a database is created by associating an optimal applying amount of the posttreatment liquid and optimal drying strength of the posttreatment dry unit 32 with each of the combinations of the resolution of the images and the types of the recording media, and the created database is stored in memory or the like in advance. With this configuration, it may be possible to refer to the database by the resolution of the input images and the types of the recording media stored in the memory. With this configuration, it may be possible to control the ejecting amount of the posttreatment liquid and the drying strength of the dry unit 32 based on the data stored in the database.

In this case, the types of the recording media may be configured such that the user inputs the types of the recording media into the image forming apparatus 100. Specifically, the types of the recording media may be configured such that the user may input into the types of the recording media (classification of paper such as thick paper or high-quality paper, or a product name of paper) via a predetermined user interface (UI). In this case, the types of the recording media may be configured such that the higher-level apparatus 71 (see FIG. 7) transmits the control information based on the information input to the printer apparatus 72 via the UI to control a posttreatment coat control part and an after-posttreatment dry control part. Alternatively, an external input device may be attached to the printer apparatus 72, such that the recording media information may be transmitted by an external input. Note that the pretreatment unit 20 and/or the pretreatment dry unit (the pretreatment dry part) 31 may be controlled based on the type of the recording media in a manner similar to those described above. In this configuration, a pretreatment coat control part and an after-pretreatment dry control part may optionally be disposed such that the pretreatment coat control part and the after-pretreatment dry control part may be controlled in a manner similar to the posttreatment coat control part and the after-posttreatment dry control part.

Specific control contents of the posttreatment dry unit (the posttreatment dry part) 32 may be as follows. That is, it may be preferable that the posttreatment dry unit (the posttreatment dry part) 32 increase the drying strength along with an increase in the applying amount of the posttreatment liquid.

Further, it may be preferable that the posttreatment dry unit (the posttreatment dry part) 32 decrease the drying strength along with a decrease in the applying amount of the pretreatment liquid.

The posttreatment unit 50 and the posttreatment dry unit (the posttreatment dry part) 32 are configured to control the applying (ejecting) amount of the posttreatment liquid and the drying strength, respectively, based on the resolution of the image to be formed on the surface of the recording medium. However, it may be preferable to control the applying (ejecting) amount of the posttreatment liquid and the drying strength as described above. That is, it may be preferable to control the applying (ejecting) amount of the posttreatment liquid and the drying strength as described above because the recording medium to which the posttreatment liquid is applied may appropriately be dried, and the shrinkage of the sheet (the recording medium) due to insufficient dryness of the recording medium or excessive dryness of the recording medium may be suppressed. Accordingly, it may be possible to stably form (print) images or apply the posttreatment liquid on the surface of the recording medium.

Second Embodiment

In a second embodiment, an image forming method of an image forming apparatus is illustrated.

The image forming method of the image forming apparatus according to the second embodiment is as follows.

There is provided a method of forming an image in an image forming apparatus. The method includes applying a pretreatment liquid on a surface of a recording medium; forming an image on the recording medium to which the pretreatment liquid is applied;

applying a posttreatment liquid onto the recording medium on which the image is formed; and drying the image formed on the recording medium and the posttreatment liquid. In this method, the applying the pretreatment liquid includes controlling an applying amount of the pretreatment liquid based on resolution of an image to be formed on the recording medium, the applying the posttreatment liquid includes controlling an applying amount of the posttreatment liquid based on the resolution of the image to be formed on the recording medium, and the drying includes controlling drying strength based on the resolution of the image to be formed on the recording medium. In the method of forming an image in the image forming apparatus according to the second embodiment, it is possible to apply the pretreatment liquid and the posttreatment liquid based on resolution of an image to be formed on the recording medium. Further, it is possible to control the dry unit such that the drying strength is set at an optimal level based on the applying amount of the pretreatment liquid and the applying amount of the posttreatment liquid.

Thus, it may be possible to suppress ink spreading or beading so as to improve the image quality. In addition, it may be possible to further suppress the shrinkage of the recording medium due to the insufficient dryness of the recording medium or excessive dryness of the recording medium.

Further, in the above-described method of forming an image, it may be preferable that the ejecting include controlling the ejecting amount of the posttreatment liquid based on the type of the recording medium, and it may also be preferable that the drying include controlling the drying strength based on the type of the recording medium.

In the above method of forming an image by controlling the ejecting amount and the drying strength, it is possible to eject a more appropriate amount of the posttreatment liquid and to set the drying strength based on the appropriate ejecting amount of the posttreatment liquid on the recording medium.

Further, it is preferable that the applying includes controlling the applying amount of the pretreatment liquid based on the type of the recording medium.

In the above method of forming an image by controlling the application amount, it is possible to apply a more appropriate amount of the pretreatment liquid, to eject a more appropriate amount of the posttreatment liquid, and to set the drying strength based on the appropriate applying amount of the pretreatment liquid and the appropriate ejecting amount of the posttreatment liquid on the recording medium. Thus, it may be possible to further suppress the beading so as to further improve the image quality. In addition, it may be possible to further suppress the shrinkage of the recording medium due to the insufficient dryness of the recording medium or excessive dryness of the recording medium.

As the image forming apparatus used in the image forming method according to the second embodiment, the image forming apparatus 100 according to the first embodiment may be used.

A configuration of the image forming apparatus used in the second embodiment may be similar to that described in the image forming apparatus according to the first embodiment as illustrated in FIGS. 1 to 4B, and hence, the duplicated description will be omitted.

FIGS. 6A to 9 illustrate the configuration and the like of the control unit 70 of the image forming apparatus 100 used in the image forming method according to second embodiment. As illustrated in FIGS. 6A to 9, the configuration of the control unit 70 of the image forming apparatus 100 used in the second embodiment may be similar to the configuration of the control unit 70 described in the image forming apparatus 100 according to the first embodiment, and hence, the duplicated description will be omitted.

In the following, image forming operations of such an image forming apparatus 100 used in the image forming method according to the second embodiment is described below with reference to FIG. 11.

Figure 11:
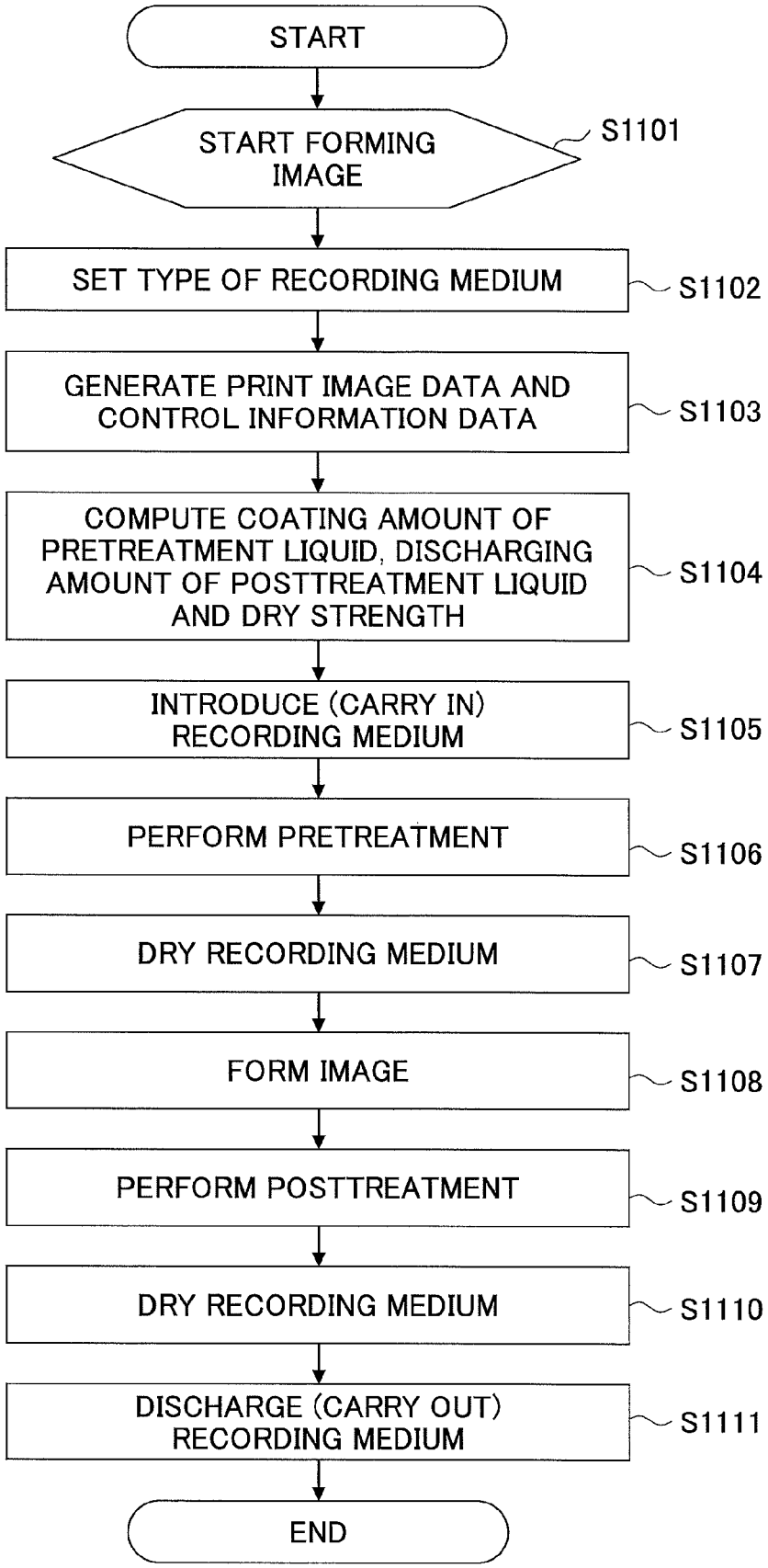
FIG. 11 is a flowchart illustrating an example of an operation performed by an image forming apparatus according to a second embodiment.

As illustrated in FIG. 11, the image forming apparatus 100 (the control unit 70) used in the image forming method according to the second embodiment starts forming an image in step S1101, based on print job data input from the outside of the image forming apparatus. After starting forming the image, the image forming apparatus 100 proceeds with a process in step S1102.

Subsequently, in step S1203, the image forming apparatus 100 sets a type of the recording medium.

Note that the control unit 70 may further store recording medium information (physical properties of the recording medium (paper materials properties, a thickness, basis weight, etc.)) supplied from the outside of the image forming apparatus 100 as the type of the recording medium. Note that the control unit 70 may store a type of the recording medium by associating the type with an appropriate one of the items of the type of the recording medium stored in advance in an HDD 71*d* of the higher-level apparatus 71 as the type of the recording medium. Accordingly, the control unit 70 may be able to retrieve the type of the recording medium utilizing a corresponding one of the associated items of the type of the recording medium in subsequent operations. The image forming apparatus 100 may be able to store the items or the like of the type of the recording medium in the HDD 71*d* or the like of the higher-level apparatus 71 in advance by the user or the like.

Subsequently, the image forming apparatus 100 proceeds with a process in step S1103. Note that when the type of the recording medium is not used as a parameter of the control, the image forming apparatus 100 may skip step S1102 and proceed with a process in a subsequent step S1103.

In step S1103, the image forming apparatus 100 generates print image data, control information, and the like utilizing the higher-level apparatus 71 of the control unit 70.

Specifically, the higher-level apparatus 71 of the control unit 70 generates the print image data, the control information, and the like based on the resolution of the image to be formed, and in some cases, the type of the recording medium stored in the HDD 71*d* or the like.

Subsequently, the image forming apparatus 100 proceeds with a process in step S1104.

In step S1104, the image forming apparatus 100 computes an applying amount (a liquid amount) of the pretreatment liquid, an ejecting amount (a liquid amount) of the posttreatment liquid, and drying strength of the dry unit by utilizing the control unit 70.

Specifically, the control unit 70 computes the applying amount of the pretreatment liquid, the ejecting amount of the posttreatment liquid, and the drying strength of the dry unit, based on resolution of the image to be formed on the recording medium, and in some cases, the type and the like of the recording medium. With respect to the dry unit, at least the drying strength of the posttreatment dry unit 32 may be computed, and the drying strength may be controlled based on the computed drying strength of the posttreatment dry unit 32. However, in a case where the pretreatment dry unit 31 is disposed, it may particularly be preferable to additionally compute drying strength of the pretreatment dry unit 31.

Note that the control unit 70 may decrease the ejecting amount of the posttreatment liquid when the resolution of the image to be formed on the recording medium is high (increased). Note also that the control unit 70 may increase the ejecting amount of the posttreatment liquid when the resolution of the image to be formed on the recording medium is low (decreased).

Further, the control unit 70 may decrease the drying strength of the posttreatment dry unit 32 when the resolution of the image to be formed on the recording medium is high (increased). Moreover, the control unit 70 may decrease the drying strength of the posttreatment dry unit 32 when the resolution of the image to be formed on the recording medium is low (decreased).

In this case, it may be preferable that the control unit 70 decrease the applying amount of the pretreatment liquid when the resolution of the image to be formed on the recording medium is high (increased). Further, it may be preferable that the control unit 70 increase the applying amount of the pretreatment liquid when the resolution of the image to be formed on the recording medium is low (decreased).

Further, it may be preferable that the control unit 70 decrease the drying strength of the pretreatment dry unit 31 when the resolution of the image to be formed on the recording medium is high (increased). Moreover, it may be preferable that the control unit 70 decrease the drying strength of the pretreatment dry unit 31 when the resolution of the image to be formed on the recording medium is low (decreased).

That is, the control unit 70 may be able to compute the applying amount of the pretreatment liquid, the ejecting amount of the posttreatment liquid, and the drying strength of the dry unit, based on the resolution of the image to be formed on the recording medium. Accordingly, the image forming apparatus 100 used in the image forming method according to the second embodiment may be able to apply the pretreatment liquid and the posttreatment liquid based on resolution of an image to be formed on the recording medium. Further, the image forming apparatus 100 used in the image forming method according to the second embodiment may be able to control the dry unit such that the drying strength is set at an optimal level after the pretreatment liquid is applied to the recording medium, and to control the dry unit such that the drying strength is set at an optimal level after the posttreatment liquid is applied to the recording medium. Thus, it may be possible to further suppress the beading by controlling the applying amount of the pretreatment liquid, the ejecting amount of the posttreatment liquid, and the drying strength of the dry unit (including the pretreatment dry unit and the posttreatment dry unit) so as to improve the image quality. In addition, it may be possible to further suppress the shrinkage of the recording medium due to the insufficient dryness of the recording medium or excessive dryness of the recording medium.

When the control unit 70 increases the applying amount of the pretreatment liquid, the control unit 70 may, for example, apply the pretreatment liquid to the recording medium in an amount of 1.5 $g/m^2$ or more. On the other hand, when the control unit 70 decreases the applying amount of the pretreatment liquid, the control unit 70 may, for example, apply the pretreatment liquid to the recording medium in an amount less than 1.5 $g/m^2$. Further, when the control unit 70 decreases the applying amount of the pretreatment liquid, the control unit 70 may, for example, apply no pretreatment liquid to the recording medium. Moreover, the control unit 70 may optionally change the applying amount of the pretreatment liquid 20L based on physical properties or the like of the recording medium.

Similarly, when the control unit 70 increases the ejecting amount of the posttreatment liquid, the control unit 70 may, for example, eject the posttreatment liquid to the recording medium in an amount of 1.2 g/m$^2$ or more. On the other hand, when the control unit 70 decreases the ejecting amount of the posttreatment liquid, the control unit 70 may, for example, eject the posttreatment liquid to the recording medium in an amount less than 1.2 g/m$^2$.

Further, when the control unit 70 decreases the ejecting amount of the pretreatment liquid, the control unit 70 may, for example, eject no posttreatment liquid to the recording medium. Moreover, the control unit 70 may optionally change the ejecting amount of the posttreatment liquid 50L based on physical properties or the like of the recording medium.

After having computed the applying amount of the pretreatment liquid, the ejecting amount of the posttreatment liquid, and the drying strength of the dry unit, the image forming apparatus 100 (the control unit 70) proceeds with a process in step S1105.

In step S1105, the image forming apparatus 100 introduces (transports) the recording medium into the pretreatment unit 20, and the like utilizing the introducing unit 10 (see FIG. 1). Note that the image forming apparatus may carry out the process in step S1105 immediately after the process in step S1101 to start forming an image.

After having started introducing the recording medium into the introducing unit 10, and the like, the image forming apparatus 100 proceeds with a process in step S1106.

In step S1106, the image forming apparatus 100 pretreats the recording medium utilizing the pretreatment unit 20 (see FIG. 2) as a pretreatment step.

Specifically, in a case of the pretreatment unit illustrated in FIG. 2, the pretreatment unit 20 controls a nip pressure by, for example, utilizing a pressure adjusting device 25 (see FIG. 2) based on the applying amount of the pretreatment liquid computed in step S1104 so as to control (change) the applying amount (e.g., film thickness) of the pretreatment liquid 20L. Note that the pretreatment unit 20 may control the applying amount of the pretreatment liquid 20L by changing the rotational speed of the coating roller 23 (see FIG. 2) as already described above.

Hence, the image forming apparatus 100 may be able to suppress image (ink) spread of the image to be formed thereafter by controlling the applying amount of the pretreatment liquid 20L of the pretreatment unit 20.

The image forming apparatus 100 then transports the recording medium to the dry unit 30 (i.e., the pretreatment dry part 31 in FIG. 1, FIG. 10), and proceeds with a process in step S1107.

In step S1107, the image forming apparatus 100 dries the recording medium utilizing the pretreatment dry unit 31 (i.e., the pretreatment dry part 31) (the heat roller 31*h*). Note that it may be preferable that the pretreatment dry unit 31 control the drying strength (a dry method) based on the resolution of the image to be formed on the recording medium, and in some cases, additionally based on the type of the recording medium.

The control method is not limited to the above-described examples. However, in a case of the heat rollers being disposed in the multiple stages as illustrated in FIG. 10, it may be possible to control the drying strength based on the combinations of the temperatures of the heat rollers and/or the number of heat rollers.

Note that in a case where no pretreatment dry unit 31 is disposed, this step (step S1107) may be skipped, and proceed with a subsequent step.

The image forming apparatus 100 then transports the recording medium to the image forming unit 40 (see FIGS. 1, 3A and 3B), and proceeds with a process in step S1108.

In step S1108, the image forming apparatus 100 forms an image on a surface of the recording medium utilizing the image forming unit 40 as an image forming step. Note that the image forming unit 40 may control an image forming method (i.e., the method of forming an image) based on the resolution of the image to be formed on the recording medium, and the type of the recording medium.

The image forming apparatus 100 then transports the recording medium to the posttreatment unit 50 (see FIG. 1), and proceeds with a process in step S1109.

In step S1109, the image forming apparatus 100 posttreats the recording medium utilizing the posttreatment unit 50 as a posttreatment step.

Specifically, the posttreatment unit 50 ejects (accumulates) the posttreatment liquid based on the ejecting amount of the posttreatment liquid computed in step S1104, or in some cases, may optionally eject (accumulate) the posttreatment liquid in a specific part of the area of the recording medium where the image is formed. Note that the posttreatment unit 50 may be able to control the ejecting amount of the posttreatment liquid based on image data associated with the posttreatment by utilizing the posttreatment liquid output part 72Ep of the control unit 70.

The image forming apparatus 100 then transports the recording medium to the dry unit 30 (i.e., the posttreatment dry part 32 in FIG. 1), and proceeds with a process in step S1110.

In step S1110, the image forming apparatus 100 dries the recording medium utilizing the posttreatment dry unit 32 (i.e., the posttreatment dry part) (the heat roller 32*h*). Note that the posttreatment dry unit 32 controls its drying strength based on the drying strength computed in step S1104 to dry the recording medium.

After having dried the recording medium, the image forming apparatus 100 proceeds with a process in step S1111.

In step S1111, the image forming apparatus 100 discharges (outputs) the recording medium utilizing the discharge unit 60 (see FIG. 1).

The image forming apparatus 100 then ends the image forming operations.

In the method of forming an image (the image forming method) in the image forming apparatus according to the second embodiment, it is possible to apply the pretreatment liquid and the posttreatment liquid based on the resolution of an image to be formed on the recording medium. Further, it is possible to control the dry unit such that the drying strength is set at an optimal level based on the applying amount of the pretreatment liquid and the ejecting amount of the posttreatment liquid.

Thus, it may be possible to suppress beading so as to improve the image quality. Further, it may be preferable to suppress the shrinkage of the sheet (the recording medium) due to insufficient dryness of the recording medium or excessive dryness of the recording medium so as to stably form (print) images on the surface of the recording medium, and in some cases to stably apply the posttreatment liquid on the surface of the recording medium.

In the method of forming an image in the image forming apparatus according to the second embodiment, it is possible to apply the pretreatment liquid and the posttreatment liquid based on an image to be formed on the recording medium. Further, it is possible to control the dry unit such that the drying strength is set at an optimal level based on the applying amount of the pretreatment liquid and the ejecting amount of the posttreatment liquid.

Thus, it may be possible to suppress ink spreading or beading so as to improve the image quality. In addition, it may be possible to further suppress the shrinkage of the recording medium due to the insufficient dryness of the recording medium or excessive dryness of the recording medium.

Note that in the above disclosures, the application methods of the pretreatment liquid and the posttreatment are expressed by utilizing words including "eject", "coat", and the like. However, such application methods of the pretreatment liquid and the posttreatment are not limited to meanings expressed by those words, but include any methods insofar as the pretreatment liquid and the posttreatment are applied.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

The present application is based on and claims the benefit of priority of Japanese Priority Application No. 2012-248645 filed on Nov. 12, 2012, the entire contents of which are hereby incorporated by reference.

What is claimed is:

1. An image forming apparatus configured to eject liquid droplets onto a recording medium to form an image on a surface of the recording medium, the image forming apparatus, comprising:

a pretreatment unit configured to apply a pretreatment liquid on the surface of the recording medium before the image is formed on the surface of the recording medium;

a posttreatment unit configured to apply a posttreatment liquid on the recording medium after the image is formed on the surface of the recording medium; and a dry unit configured to dry the image formed on the recording medium and the posttreatment liquid, wherein the pretreatment unit controls an applying amount of the pretreatment liquid based on resolution of an image to be formed on the recording medium, the posttreatment unit controls an applying amount of the posttreatment liquid based on the resolution of the image to be formed on the recording medium, and the dry unit controls drying strength based on the resolution of the image to be formed on the recording medium.

2. The image forming apparatus as claimed in claim 1, wherein the posttreatment unit increases the applying amount of the posttreatment liquid and the dry unit increases the drying strength along with a decrease in the resolution of the image to be formed on the surface of the recording medium, and wherein the posttreatment unit decreases the applying amount of the posttreatment liquid and the dry unit decreases the drying strength along with an increase in the resolution of the image to be formed on the surface of the recording medium.

3. The image forming apparatus as claimed in claim 1, wherein the posttreatment unit and the dry unit further control the applying amount of the posttreatment liquid and the drying strength, respectively, based on a type of the recording medium.

4. The image forming apparatus as claimed in claim 1, wherein the dry unit increases the drying strength along with an increase in the applying amount of the posttreatment liquid.

5. The image forming apparatus as claimed in claim 1, wherein the dry unit decreases the drying strength along with a decrease in the applying amount of the posttreatment liquid.

6. A method of forming an image in an image forming apparatus, the method comprising:

applying a pretreatment liquid on a surface of a recording medium;

forming an image on the recording medium to which the pretreatment liquid is applied;

applying a posttreatment liquid onto the recording medium on which the image is formed; and drying the image formed on the recording medium and the posttreatment liquid, wherein the applying the pretreatment liquid includes controlling an applying amount of the pretreatment liquid based on resolution of an image to be formed on the recording medium, the applying the posttreatment liquid includes controlling an applying amount of the posttreatment liquid based on the resolution of the image to be formed on the recording medium, and the drying includes controlling drying strength based on the resolution of the image to be formed on the recording medium.

7. The image forming apparatus as claimed in claim 6, wherein the applying the posttreatment liquid further includes controlling the applying amount of the posttreatment liquid based on a type of the recording medium, and wherein the drying further includes controlling the drying strength based on the type of the recording medium.

* * * * *